US010883699B2

(12) United States Patent
Liu et al.

(10) Patent No.: US 10,883,699 B2
(45) Date of Patent: Jan. 5, 2021

(54) LENS COMBINATION AND ILLUMINATION DEVICE ADOPTING THE SAME

(71) Applicant: OPPLE LIGHTING CO., LTD., Shanghai (CN)

(72) Inventors: Chaobo Liu, Shanghai (CN); Shitao Deng, Shanghai (CN); Jing Yang, Shanghai (CN); Jianguo Li, Shanghai (CN); Xiufeng Shi, Shanghai (CN); Cong Wang, Shanghai (CN); Guoping Zhang, Shanghai (CN); Jian Zhu, Shanghai (CN); Kai Wang, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 15/956,678

(22) Filed: Apr. 18, 2018

(65) Prior Publication Data

US 2018/0245771 A1 Aug. 30, 2018

Related U.S. Application Data

(63) Continuation of application No. PCT/CN2016/102962, filed on Oct. 21, 2016.

(30) Foreign Application Priority Data

Oct. 23, 2015 (CN) ..... 2015 1 0697146
Oct. 23, 2015 (CN) ..... 2015 2 0829580 U
Oct. 19, 2016 (CN) ..... 2016 2 1138163 U

(51) Int. Cl.
*F21V 5/00* (2018.01)
*F21V 5/04* (2006.01)
(Continued)

(52) U.S. Cl.
CPC ..... *F21V 5/007* (2013.01); *F21V 5/04* (2013.01); *F21V 5/043* (2013.01); *F21V 7/041* (2013.01);
(Continued)

(58) Field of Classification Search
CPC .. F21V 5/046; F21V 5/007; F21V 5/04; F21S 8/046; F21S 8/026
See application file for complete search history.

(56) References Cited

U.S. PATENT DOCUMENTS

2003/0053310 A1* 3/2003 Sommers ..... F21V 5/006 362/231
2012/0175655 A1* 7/2012 Cheng ..... F21V 13/04 257/98
(Continued)

FOREIGN PATENT DOCUMENTS

CN 102980137 A 3/2013
CN 204372715 U 6/2015
(Continued)

OTHER PUBLICATIONS

International Search Report and Written Opinion dated Jan. 23, 2017 for PCT/CN2016/102962. 5 pages.

*Primary Examiner* — Eric T Eide
(74) *Attorney, Agent, or Firm* — Arch & Lake LLP

(57) ABSTRACT

The present disclosure provides a lens combination and an illumination device adopting the lens combination, where, the lens combination configured for accommodation at least a first light source and a second light source, includes: a first lens, including a first light incident surface, a first light emergent surface and a first accommodation space located on a side of the first light incident surface and configured for accommodating the first light source, where the first light incident surface and the first light emergent surface are of a curved surface shape; and a second lens, including a second
(Continued)

light incident surface, a second light emergent surface, and a second accommodation space located on a side of the second light incident surface and configured for accommodating the second light source, where the second light incident surface and the second light emergent surface are of a curved surface shape.

26 Claims, 16 Drawing Sheets

(51) Int. Cl.
*F21Y 105/18* (2016.01)
*F21Y 115/10* (2016.01)
*F21V 7/04* (2006.01)

(52) U.S. Cl.
CPC ..... *F21Y 2105/18* (2016.08); *F21Y 2115/10* (2016.08)

(56) References Cited

U.S. PATENT DOCUMENTS

2013/0077307 A1* 3/2013 Yamamoto ..... F21S 8/026 362/244
2013/0083541 A1* 4/2013 Fang ..... F21V 5/007 362/311.02
2013/0249407 A1* 9/2013 Kashiwagi ..... H05B 45/24 315/151
2013/0293148 A1* 11/2013 Holland ..... F21V 5/04 315/297
2014/0160748 A1* 6/2014 Tsai ..... F21V 7/0016 362/235
2014/0185285 A1* 7/2014 Jorgensen ..... F21V 14/02 362/232
2014/0204594 A1* 7/2014 Kanazawa ..... F21S 8/026 362/362
2014/0301071 A1* 10/2014 Jorgensen ..... F21V 14/06 362/231
2014/0334149 A1* 11/2014 Nolan ..... F21V 5/007 362/235
2015/0003074 A1* 1/2015 Calvin ..... F21V 13/04 362/297
2015/0159830 A1* 6/2015 Joergensen ..... F21V 5/007 362/237
2015/0176823 A1 6/2015 Leshniak
2015/0184827 A1* 7/2015 Lin ..... F21V 5/04 362/311.02
2018/0220508 A1* 8/2018 Pilat ..... F21S 8/061

FOREIGN PATENT DOCUMENTS

CN 105179982 A 12/2015
CN 105202394 A 12/2015
CN 105221965 A 1/2016
CN 205037137 U 2/2016
CN 205037138 U 2/2016
WO 2015100201 A 7/2015

* cited by examiner

LENS COMBINATION AND ILLUMINATION DEVICE ADOPTING THE SAME

CROSS-REFERENCE TO RELATED APPLICATIONS

This application is based upon and claims the priority of PCT patent application No. PCT/CN2016/102962 filed on Oct. 21, 2016 which claims the priority of Chinese Patent Application No. 201510697146.0 filed on Oct. 23, 2015, Chinese Patent Application No. 201520829580.5 filed on Oct. 23, 2015, and Chinese Patent Application No. 201621138163.7 filed on Oct. 19, 2016, the entire contents of all of which are hereby incorporated by reference herein for all purposes.

TECHNICAL FIELD

The present disclosure relates to a technical field of illumination, and more particularly, to a lens combination and an illumination device adopting the same.

BACKGROUND

At present, an illumination device typically includes a light source module and a lens in cooperation with the light source module, to focus or collimate light emitted by the above-described light source module through the lens.

In order to achieve the above-described purpose of focusing or collimating light, when the illumination device includes a plurality of light sources, one lens covering the light source is cooperatively provided for each light source, and thus, it is necessary to provide a plurality of lenses for the illumination device including a plurality of light sources.

However, if lenses covering the light source is provided for different light sources respectively, due to unavoidable deviation in a process of the respective lenses themselves, it is difficult to ensure a same light distribution effect after light emitted by different light sources passes through the lenses covering the light sources, which further affects an illumination effect of the illumination device.

SUMMARY

The present disclosure provides a lens combination.

According to a first aspect of the present disclosure, a lens combination for accommodating at least a first light source and a second light source is provided. The lens combination may include a first lens, including a first light incident surface, a first light emergent surface and a first accommodation space located on a side of the first light incident surface and configured for accommodating the first light source, where the first light incident surface and the first light emergent surface are of a curved surface shape. The lens combination may include a second lens, including a second light incident surface, a second light emergent surface, and a second accommodation space located on a side of the second light incident surface and configured for accommodating the second light source, where the second light incident surface and the second light emergent surface are of a curved surface shape.

According to the first aspect, an emergent light obtained after an incident light emitted by a first light source passes through the first light incident surface and the first light emergent surface and an emergent light obtained after an incident light emitted by the second light source passes through the second light incident surface and the second light emergent surface are consistent in light type.

According to a second aspect of the present disclosure, a lens combination is provided. The lens combination may include a second lens and a first lens provided on an outer periphery of the second lens, where the first lens includes a first light incident surface and a first light emergent surface, the second lens includes a second light incident surface and a second light emergent surface, the first light incident surface and the second light incident surface, and the first light emergent surface and the second light emergent surface are all curved surfaces, and a first sectional surface of the first lens obtained along a first cross-section line and a surface type of a second sectional surface of the second lens obtained along the first cross-section line are not consistent in surface type.

According to a third aspect of the present disclosure, an illumination device adopting lens combination is provided. The illumination device adopting lens combination may include a housing; a light source module, located within the housing, where the light source module includes a substrate and a first light source and a second light source provided on the substrate; and a lens combination that includes a base portion, and a first lens and a second lens provided on the base portion, the first lens being annular, and the second lens is annularly enclosed within the first lens; where the base portion of the lens combination is integrated with the substrate and the housing of the light source module, the first lens and the second lens distribute light for the first light source and the second light source respectively, the first lens corresponds to at least one group of first lenses annularly arranged on the substrate, and the second lens corresponds to at least one second light source annularly enclosed within the first light source.

It is to be understood that both the foregoing general description and the following detailed description are exemplary and explanatory only and are not restrictive of the present disclosure.

BRIEF DESCRIPTION OF THE DRAWINGS

In order to clearly illustrate the technical solutions of the examples of the present disclosure, the drawings that need to be used in the will be briefly described hereinafter; it is obvious that the described drawings are only related to some examples of the present disclosure, those ordinary skilled in the art can obtain other drawings based on the drawings, without any inventive work.

Figure 1:
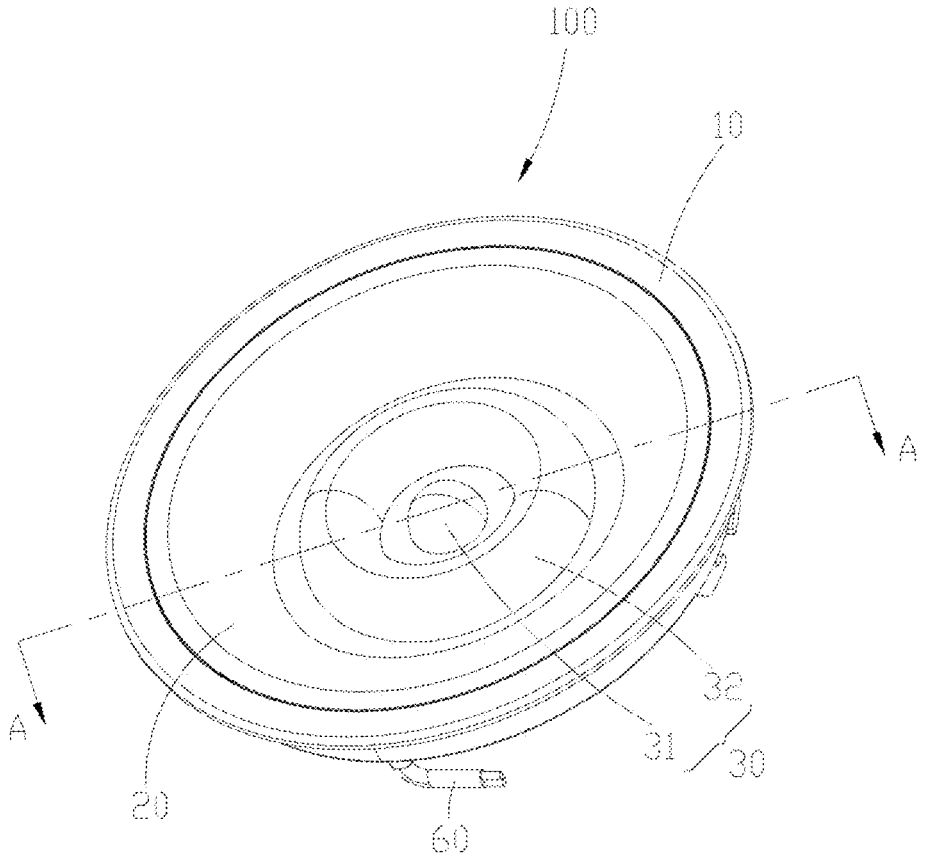
FIG. 1 is a perspective view of an illumination device provided by Example 1 of the present disclosure.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples of the present disclosure. Also, common but well-understood elements that are useful or necessary in a commercially feasible example are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above, except where different specific meanings have otherwise been set forth herein.

DETAILED DESCRIPTION

In order to make those skilled in the art better understand the technical solutions of the examples of the present disclosure, hereinafter, the technical solutions of the examples of the present disclosure will be described in a clearly and fully understandable way in conjunction with the drawings related to the examples of the present disclosure. It is obvious that the described examples are just part of rather than all of the examples of the present disclosure. Based on the examples in the present disclosure, those skilled in the art can obtain other example(s), without any inventive work, which should be within the scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

As disclosed below, Example 1 of the present disclosure provides an illumination device, to solve a problem that it is difficult to ensure coincidence of emergent light types of light emitted from respective light sources included in the above-described illumination device after it is transmitted through the respective lenses.

Figure 2:
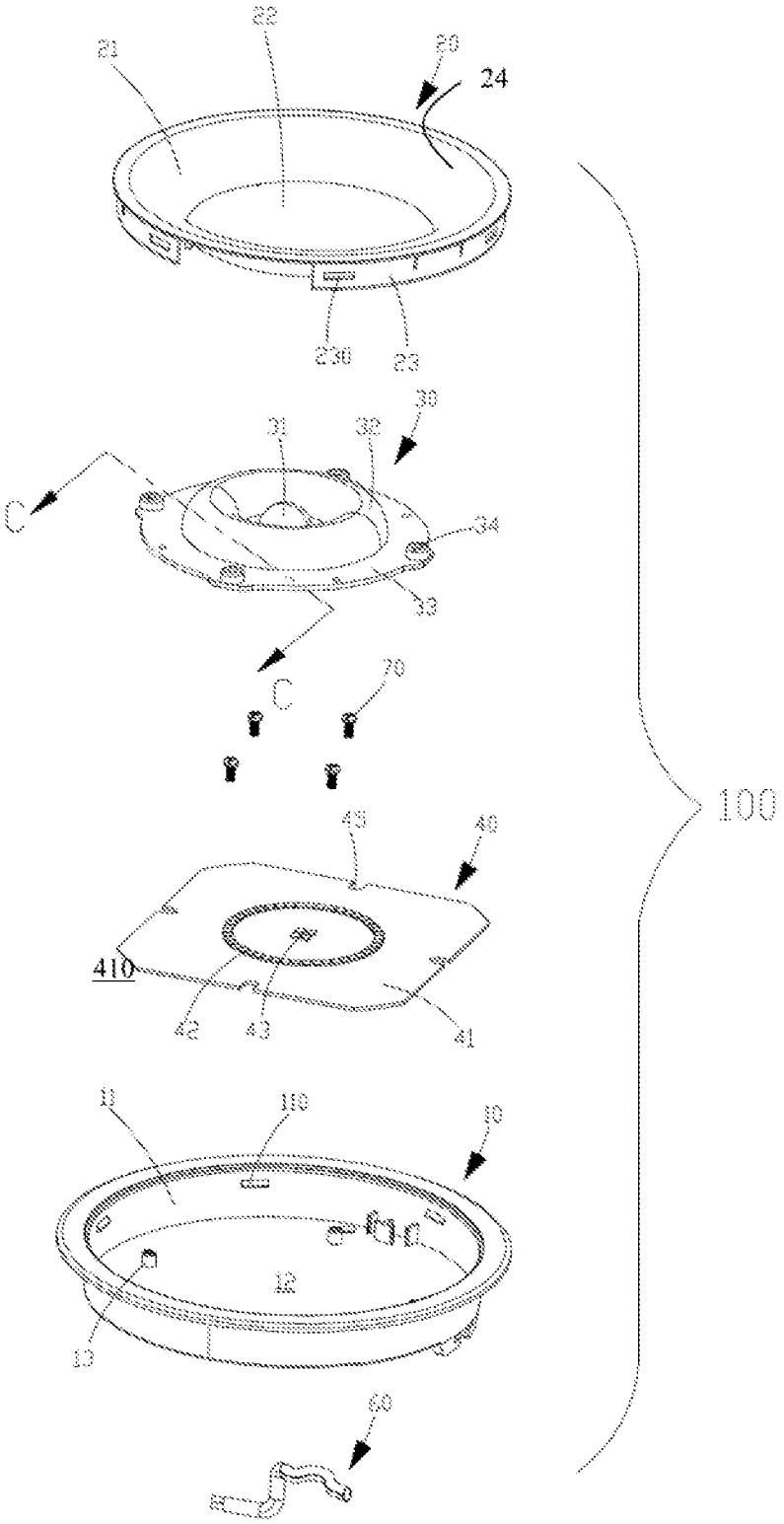
FIG. 2 is an exploded perspective view of the illumination device provided by Example 1 of the present disclosure.

With combination reference to FIG. 1 and FIG. 2, an illumination device 100 according to this example can comprise a housing 10, a light source module 40 provided within the housing 10 and a lens combination 30 in cooperation with the light source module 40.

The light source module 40 can include a substrate 41, a plurality of annularly arranged first light sources 42 provided on a first surface 410 of the substrate 41, one or more second light sources 43 provided on the first surface 410 of the substrate 41. Wherein, the second light source 43 is located at a position of an annulus center of the above-described first light source 42. The first light source 42 and the second light source 43 as described above can be light emitting diodes (LEDs), or other types of light emitters. The above-described light source module 40 further includes an electronic device (not shown) provided on the substrate 41. The light source module 40 can be provided with a drive module integrated thereon (not shown) for driving the light source module 40, the drive module can be integrated on the first surface 410 of the substrate 41, or on the second surface facing away from the first surface 410.

Accordingly, the lens combination 30 may comprise a base portion 33 for bonding to the substrate 41 of the above-described light source module 40, a first lens 32 connected with the base portion 33 and having an annular shape, and a second lens 31 connected with the base portion 33 and located in an annulus center of the first lens 32. Wherein, the above-described first lens 32 is provided in cooperation with the above-described first light source 42 of the light source module, and the above-described second lens 31 is provided in cooperation with the second light source 43 of the above-described light source module 40.

It should be noted that, the above-described lens combination 30 is a lens component comprising at least two lenses, the at least two lenses can be provided integrally or non-integrally, and the number of lenses comprised in the lens combination 30 is not limited thereto. In the example of the present application, the above-described second lens 31 can be ring-shaped or non ring-shaped (e.g., dot-shaped). Preferably, if the first lens 32 and the second lens 31 are both ring-shaped, then the annulus center of the first lens 32 (i.e., the annulus center of the annulus presented by the lens) coincides with the annulus center of the second lens 31; if the first lens 32 is ring-shaped and the second lens 31 is dot-shaped, then a position of the second lens 31 can be arranged on the annulus center of the first lens 32, and further, if the second lens 31 is dot-shaped, then a center of the dot of the second lens 31 can be set to coincide with the annulus center of the above-described first lens 32. Of course, in a feasible example of the present application, mutual positions of the first lens 32 and the second lens 31 as described above are not limited.

Preferably, in order to further enhance a light emitting effect and aesthetics of the illumination device 100, the above-described illumination device 100 can further comprise a reflective member 20 provided within the housing 10 and annularly arranged. The reflective member 20 is around the outside of the first lens 32. The reflective member 20 includes an arc-shaped reflecting surface 21 and an opening 22 through which the lens combination 30 passes when mounting. The above-described reflective member 20 can perform mirror reflection, diffuse reflection, or reflection of an absorptive type, and the like.

In the example of the present disclosure, the housing 10 can include a bottom wall 12 and a side wall 11 connected with the bottom wall 12; the bottom wall 12 is provided thereon with a plurality of fixing screw holes 13. Accordingly, the substrate 41 of the light source module 40 is provided thereon with a plurality of positioning portions 45. The base portion 33 of the lens combination 30 is provided thereon with a plurality of fixing via holes 34. The side wall 11 of the housing 10 is also provided thereon with a plurality of fastening portions 110 projecting inwardly from the side wall 11. The reflective member 20 is also provided with a mounting wall 23 fitting for the side wall 11 of the housing 10, which extends from an upper surface 24 of the reflective member 20 downwardly as a vertical side wall and is provided surrounding the outside of the reflecting surface 21 of the reflective member 20. The mounting wall 23 is provided thereon with a plurality of fastening holes 230 for cooperating with the above-described fastening portion 110.

During the mounting process, firstly, the light source module 40 is placed on the bottom wall 12 of the housing 10, and during the placing process, the plurality of positioning portions 45 of the above-described light source module 40 are fitted over the plurality of fixing screw holes 13 on the above-described bottom wall 12 respectively, then the lens combination 30 is placed on the first surface 410 of the substrate 41 on which the first light source 42 is provided. Similarly, during the placing process, positions of the plurality of fixing via holes 34 of the lens combination 30 can be aligned with positions of the plurality of fixing screw holes 13, the light source module 40 and the lens combination 30 as described above are fixed within the housing 10, by bolts 70 in cooperation with the fixing screw holes 13. Of course, the combining mode of the light source module 40 and the lens combination 30 as described above is not limited thereto, which may also be adhesive, riveting, and the like. Subsequently, the reflective member 20 is placed on the base portion 33 of the lens combination 30, and its reflecting surface 21 is provided surrounding the periphery of the first lens 32 of the lens combination 30, and mutual fixation between the reflective member 20 and the housing 10 is implemented by the fastening portion 110 and the fastening hole 230 in cooperation with each other. After assembling, an upper surface 24 of the reflective member 20 is flush with an upper surface of the housing 10, and the reflecting surface 21 and the side wall 11 of the housing 10 form an accommodation space 25 for accommodating the electronic device (not shown) of the light source module 40. In this example, by disposing the electronic device within the above-described accommodation space 25, it is possible to effectively reduce a thickness of the illumination device, so that the illumination device is lighter and thinner. Wherein, the electronic device can include a drive module (not shown), so that the drive module is also accommodated within the accommodation space 25. Of course, the above-described drive module may also be integrally onto the substrate 41 together with the light source module. Similarly, the combining mode the reflective member 20 and the housing 10 as described above is not limited thereto, which may also be adhesive, riveting, and the like. It should be noted that the illumination device 100 further comprises a lead 60 mounted at a bottom of the housing 10, and the lead 60 is electrically connected with the light source module 40.

Sometimes, the first lens and the second lens may have different cross-sectional surface types but the same light type. Alternatively, the first lens and the second lens may have the same cross-sectional surface type but different light types.

Figure 3:
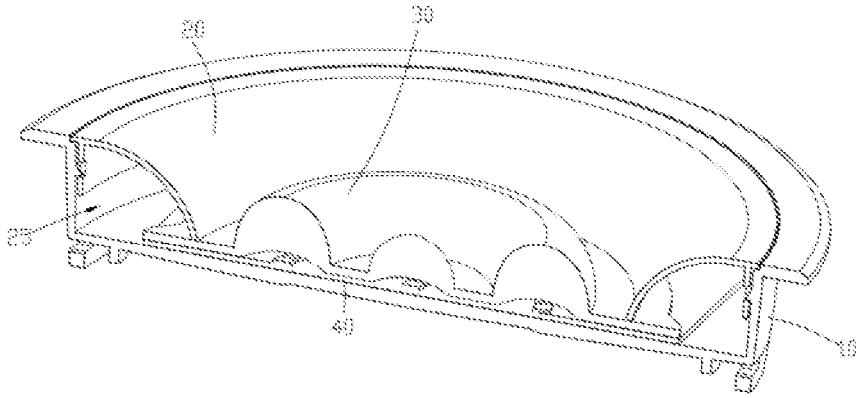
FIG. 3 is a perspective sectional schematic view of the illumination device in a direction of a line A-A of FIG. 1.
Figure 4:
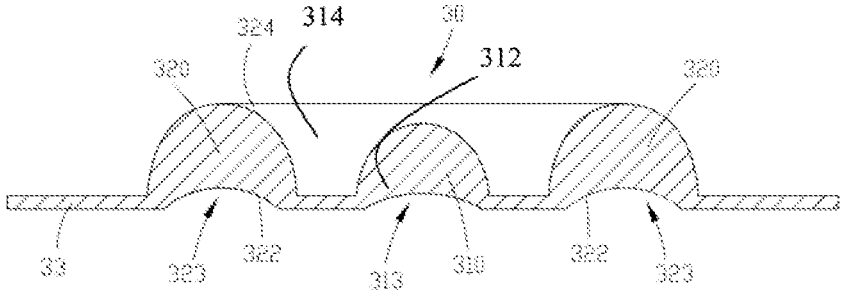
FIG. 4 is a sectional schematic view of a lens combination in the direction of the line A-A of FIG. 1.
Figure 5:
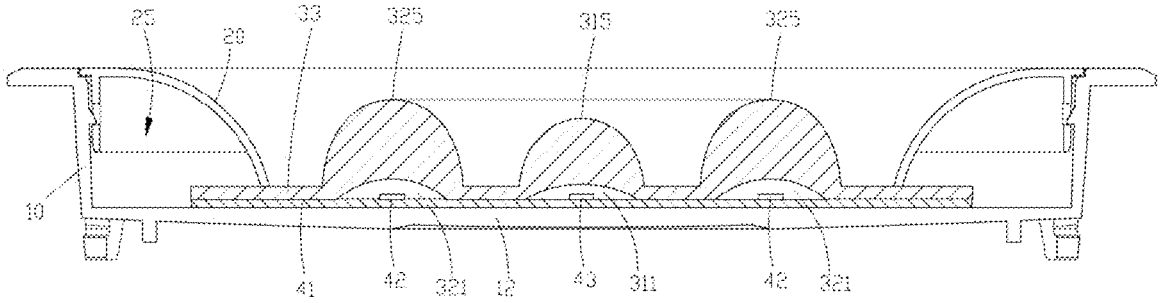
FIG. 5 is a front view of the sectional perspective schematic view shown in FIG. 3.

With reference to FIG. 3 to FIG. 5, wherein, it is defined that a cross section shown in FIG. 3 to FIG. 5 is obtained by cross-sectioning along a first cross-section line (i.e., an A-A direction shown in FIG. 1), and the first cross-section line passes through the annulus center of the first lens 32. The first lens 32 includes a first lens main body 320 having an annular shape and a first groove 323 formed inwardly recessed from the base portion 33, the second lens 31 includes a second lens main body 310 and a second groove 313 formed inwardly recessed from the base portion 33. The above-described first lens 32 has a first light incident surface 322 and a first light emergent surface 324 opposite to each other. When the lens combination 30 and the light source module 40 are assembled, due to presence of the above-described first groove 323, a first cavity 321 for accommodating the above-described first light source 42 can be form between the above-described first light incident surface 322 and the above-described first surface 410 (with reference to FIG. 2). Similarly, the above-described second lens 31 also has a second light incident surface 312 and a second light emergent surface 314 opposite to each other, and when the lens combination 30 and the light source module 40 are assembled, due to present of the above-described second groove 313, a second cavity 311 for accommodating the above-described second light source 43 is formed between the second light incident surface 312 of the second lens 31 and the above-described first surface 410. In the example of the present disclosure, the annularly distributed first light sources 42 of the light source module 40 can be accommodated within the first cavity 321 of the above-described first lens 32, and as compared with other examples, more light sources can be provided within limited space of the illumination device 100, to further improve luminous efficiency of the illumination device 100. In addition, the lens combination 30 may accordingly adjust the number of first light sources 42 located within the first lens 32, according to a size of a desired light flux. Moreover, the above-described lens combination 30 can share various packages, with good compatibility, and an arrangement mode of the light source on the substrate 41 is more flexible.

Besides, it should be noted that, in the example of the present disclosure, the first light incident surface 322 and the first light emergent surface 324 of the first lens 32 are provided as curved surfaces, and a curvature radius of the first light incident surface 322 is larger than a curvature radius of the first light emergent surface 324. Similarly, the second light incident surface 312 and the second light emergent surface 314 of the second lens 31 are provided as curved surfaces, and a curvature radius of the second light incident surface 312 is larger than a curvature radius of the second light emergent surface 314. In this way, when the light source of the illumination device is mounted within the lens combination 30, incident light emitted by the light source is completely transmitted through the lens combination 30 to be emitted outward, and the above-described first lens 32 and the second lens 31 with curved surface shape can render better luminous efficiency and better light distribution effect. Since in the example of the present disclosure, the substrate 41 of the light source module 40 and the base portion 33 of the lens combination 30 are bonded to each other, to form the first cavity or the second cavity surrounded by the substrate 41 and the base portion 33, the respective first light sources and the respective second light sources are completely accommodated within the first cavity 321 or the second cavity 311, so that it is possible to ensure that incident light is completely transmitted from the lens combination 30 and irradiated to the outside of the illumination device, resulting in higher luminous efficiency.

With reference to FIG. 4, in order that light distribution effects of respective light sources on the illumination device after passing through the above-described lens combination 30 coincide with one another (i.e., the emergent light types coincide with one another), in this example, a surface type of the first sectional surface obtained along the first cross-section line in the first lens 32 and a surface type of the second sectional surface obtained along the first cross-section line in the second lens 31 is not consistent with one another. In this example, in a thickness direction of the base portion 33, a height of the above-described first lens 32 is not equal to a height of the second lens 31 in the thickness direction of the base portion 33. That is, if the height of the first lens 32 in the thickness direction of the base portion 33 is defined as a first vertical distance from a first top portion 325 of the first lens 32 to the base portion 33; and the height of the second lens 31 in the thickness direction of the base portion 33 is defined as a second vertical distance from a second top portion 315 of the second lens 31 to the base portion 33; then the above-described first vertical distance can be larger than or smaller than the second vertical distance. Of course, in a preferred example, the above-described first vertical distance is set to be larger than the above-described second vertical distance. With specific reference to FIG. 4 and FIG. 9, a maximum height of the first light incident surface 322 of the above-described first lens 32 in the thickness direction of the base portion 33 is slightly larger than a maximum height of the second light incident surface 312 of the second lens 31 in the thickness direction of the base portion 33, and both heights are substantially close to the thickness of the base portion 33. In an alternative example, the a surface type of the first sectional surface obtained along the first cross-section line in the first lens 32 and a surface type of the second sectional surface obtained along the first cross-section line in the second lens 31 are identical with each other. So, the cross-sectional views of the first lens 32 and the second lens 31 are the same.

Figure 6:
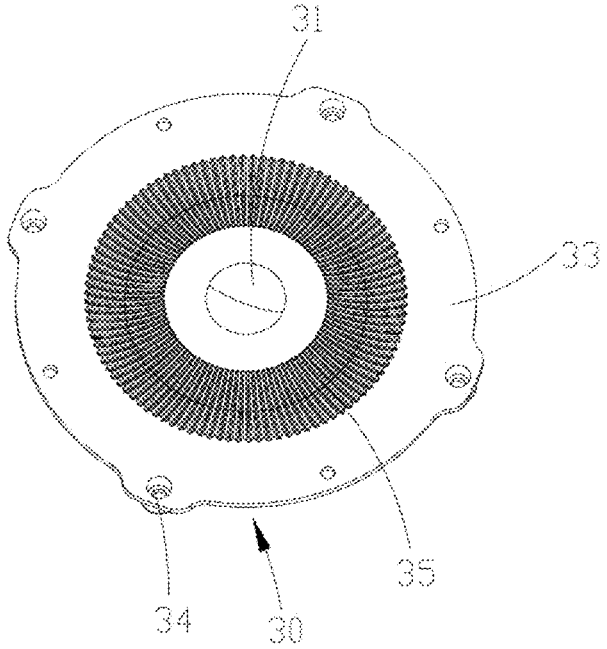
FIG. 6 is a structural schematic view of the lens combination, on a side of a light incident surface, in Example 1 of the present disclosure.

As shown in FIG. 6, it is a structural schematic view of the first lens at a side of the first light incident surface. In a practical use process, a situation that a small number of light sources are not lit may appear in the illumination device, the situation may result in granular sensation when a human eye observes the illumination device through the lens. In order to eliminate the above-described granular sensation and enhance a visual effect, in this example, a granular-sensation eliminating layer 35 with a concavo-convex shape can be formed on the first light incident surface 322 or the first light emergent surface 324 of the first lens 32. The granular-sensation eliminating layer 35 can be a concavo-convex structure integrally formed on the first light incident surface 322 and/or the first light emergent surface 324 of the first lens 32 in any form, for example, a "V-shaped" structure. Of course, the above-described granular-sensation eliminating layer 35 in the concavo-convex shape can be simultaneously provided on the first light incident surface 322 and the first light emergent surface 324. In a same principle, the above-described granular-sensation eliminating layer 35 may also be formed on the second light incident surface or the second light emergent surface of the second lens 31.

Figure 7A:
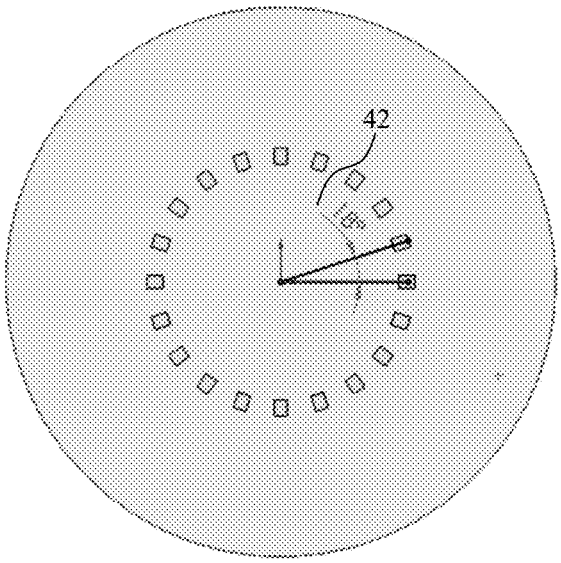
FIG. 7*a* and FIG. 7*b* are schematic views showing arrangement of a first light source on a light source module in Example 1 of the present disclosure.
Figure 7B:
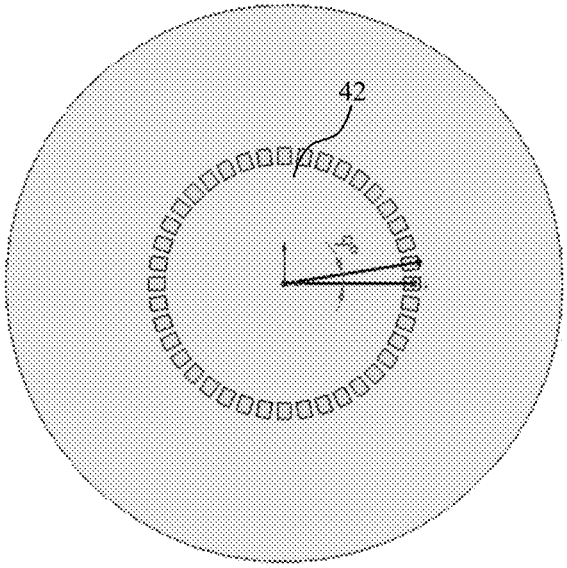

With reference to FIG. 7*a* and FIG. 7*b*, it is schematic views showing arrangement of the first light source on the light source module in the example of the present disclosure. Wherein, it can be seen that the number of annularly arranged first light sources 42 can be adjusted according to needs. A distribution angle of the first light source 42 is defined as: an angle formed by a connection line between one first light source 42 and the annulus center and a connection line between another one first light source 42 adjacent to the one first light source 42 and the annulus center. Then, the number of the first light sources 42 in FIG. 7*a* is 20, its distribution angle is 18°, the number of first light sources 42 in FIG. 7*b* is 40, and its distribution angle is 9°. In the example of the present disclosure, in order to eliminate a phenomenon of light spots caused by non-controllable light in a stretching direction of the annular first lens 32, a concavo-convex structure can be formed on the first light incident surface 322 or the first light emergent surface 324 of the first lens 32; the concavo-convex structure can include one or more of an etch structure formed by an etching process, and a frosted structure formed by a scrub process. In this example, with the etch structure or the frosted structure as described above, a dispersion angle of emergent light obtained after incident light generated by the above-described first light source 42 passes through the first lens may meet a certain requirement.

Figure 8:
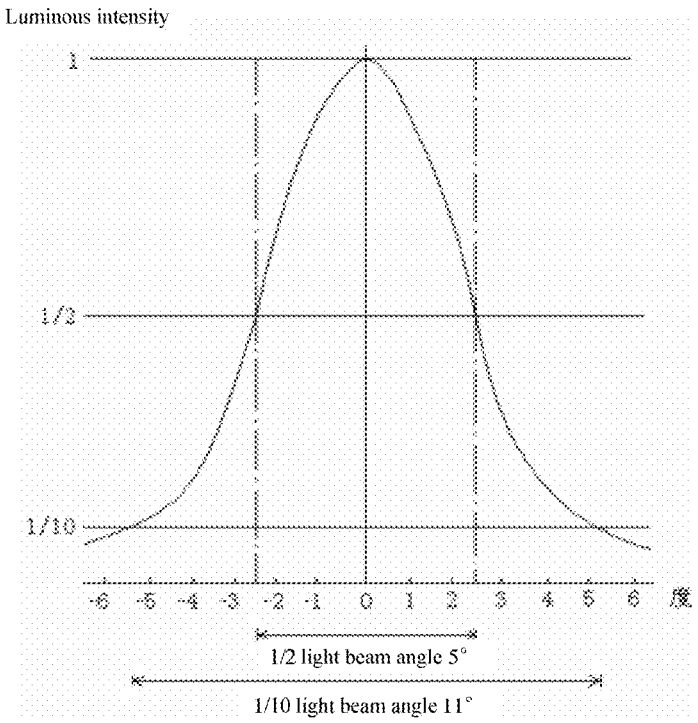
FIG. 8 is a schematic view of a light distribution curve in Example 1 of the present disclosure.

With reference to FIG. 8, it is a schematic view of a light distribution curve in the example of the present disclosure. With respect to a definition of the above-described dispersion angle, it refers to that: when a bundle of parallel rays is incident on the first lens 32, and emergent light of ½ intensity corresponding to half of a maximum value of emergent light intensity is determined, then, the dispersion angle refers to an included angle formed by two emergent light rays of ½ intensity. For example, in the light distribution curve of FIG. 8, if the maximum intensity of the emergent light is 1 (light of the maximum intensity is concentrated at a normal line position of the first lens), then emergent light of ½ intensity is distributed in the above-described normal line ±2.5° position; and thus, the dispersion angle at this time is 5°.

In order to obtain a uniform light spot, in this example, the etch structure or the frosted structure makes the dispersion angle of the first lens 32 to be positively correlated with the distribution angle of the first light source 42. That is, when the distribution angle becomes small, it is necessary to reduce a size of the above-described dispersion angle accordingly; and when the distribution angle becomes large, it is necessary to increase the size of the above-described dispersion angle accordingly. For example, when the distribution angle is 18°, the above-described dispersion angle can be 12°, and when the distribution angle is 9°, the above-described dispersion angle can be 6°.

Figure 9:
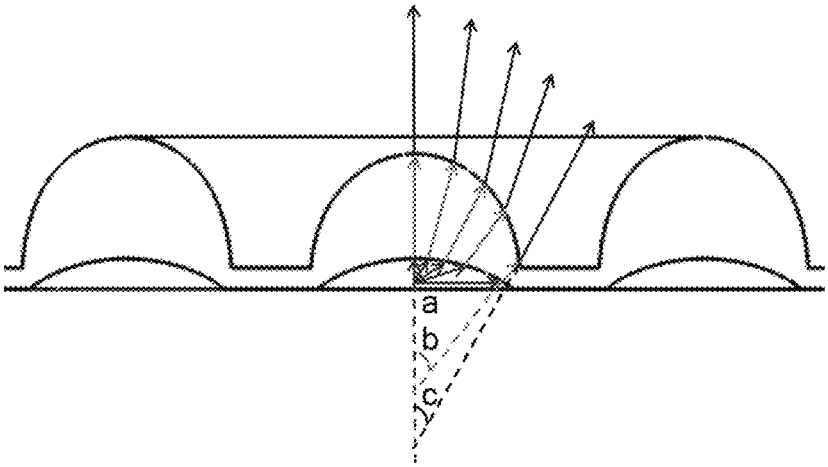
FIG. 9 is an optical path diagram of light emitted by the light source passing through the light incident surface and a light emergent surface of a lens in Example 1 of the present disclosure.
Figure 10:
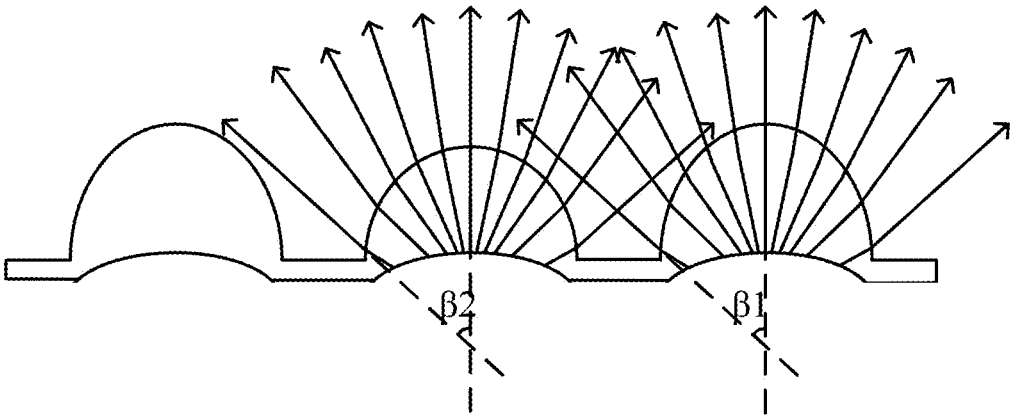
FIG. 10 is an optical path diagram of light emitted by the first and second light sources passing through the lens combination in Example 1 of the present disclosure.

With reference to FIG. 9, it is an optical path diagram of incident light of the light source passing through the lens in the present disclosure. Both the light incident surface and the light emergent surface of the lens have a convergence effect on light. Wherein, an included angle between the normal line and light incident from the light source is defined as a, an included angle between the normal line and light incident from the light source and refracted by the light incident surface is defined as b; and an included angle between the normal line and light incident from the light source and refracted by the light incident surface and further refracted by the light emergent surface is defined as c. In general, the above-described included angle a is in a range of 0° to 90°, and as refracted by the light incident surface, the above-described included angle b become in a range of 0° to 65°, and as refracted by the light emergent surface, the above-described included angle c become in a range of 0° to 50°. With reference to FIG. 10, it is an optical path diagram of light emitted by the first light source and the second light source passing through the lens combination. If the light type of the emergent light is defined as a maximum included angle between the normal line and the emergent light obtained after light emitted by the light source is refracted through the above-described lens (the first lens 32 or the second lens 31). For example, a maximum included angle between the normal line and the emergent light obtained after light emitted from the first light source 42 within the first lens 32 is refracted by the first light incident surface 322 and the first light emergent surface 324 of the first lens 32 is β1, and a maximum included angle between the normal line and the emergent light obtained after light emitted by the second light source 43 within the second lens 31 is refracted by the second light incident surface and the second light emergent surface of the second lens 31 is β2. Thus, the light type of the emergent light obtained after light emitted by the first light source 42 passes through the first lens 32 coincides with the light type of the emergent light obtained after light emitted by the second light source 43 passes through the second lens 31, which can be understood as that the above-described included angle β1 and the above-described included angle β2 are equal. It can be seen that, since in the example of the present disclosure, the first lens 32 is arranged in an annular shape, the second lens 31 is arranged in a dot shape; if the surface type of the sectional surface of the first cross section corresponding to the annular first lens 32 is set to be the same as the surface type of the sectional surface of the second cross section corresponding to the dot-shaped second lens 31, it is difficult to achieve an effect that the light type of the emergent light of the first light source 42 after passing through the first lens 32 and the light type of the emergent light of the second light source 43 after passing through the second lens 31 coincide completely. To this end, in this example, the sectional surface type of the first cross section corresponding to the above-described first lens 32 is set not to coincide with the sectional surface type of the second cross section corresponding to the above-described second lens 31, so as to implement that light distribution types of the two are the same. Based on the above, according to the present disclosure, the sectional surface types of the first lens 32 and the second lens 31 are set not to coincide, so as to implement that the first lens 32 and the second lens 31 have the same light distribution effect (i.e., the above-described included angle β1 and the above-described included angle β2 are equal). In general, due to different fabrication processes, the dot-shaped second lens 31 is a rotationally symmetric surface type, while the annular first lens 32 is not a rotationally symmetrical surface type; it is assumed that a maximum included angle β2 between emergent light obtained after incident light passes through the dot-shaped second lens 31 and the normal line is 60°, if the sectional surface type of the annular first lens 32 is set to be the same as the sectional surface type of the second lens 31, then it is possible that the maximum included angle β2 between emergent light obtained after incident light passes through the first lens 32 and the normal line is usually larger than 60° (e.g., 70° to 80°). For the above-described reasons, in the present disclosure, in order that the annular first lens 32 and the dot-shaped second lens 31 have the same light distribution effect, the sectional surface type of the above-described first lens 32 is changed by a process, so that the maximum included angle β2 between emergent light obtained after incident light passes through the first lens 32 and the normal line is maintained at 60°. In respective examples of the present disclosure, a mode of changing the sectional surface shape of the first lens 32 can include changing curvatures of the first light incident surface 322 and the first light emergent surface 324 of the first lens 32, or changing the height of the first lens 32, or changing a width of the first lens 32, and the like, which will not be limited by the present disclosure.

In summary, the lens combination used in the illumination device according to Example 1 of the present disclosure allows the light type of the emergent light obtained after incident light emitted by the first light source accommodated in the first accommodation space passes through the first light incident surface and the first light emergent surface to coincide with the light type of the emergent light obtained after incident light emitted by the second light source accommodated in the second accommodation space passes through the second light incident surface and the second light emergent surface, so that it is possible to ensure that the first lens and the second lens in the lens combination can have the same light distribution effect, and avoid providing one lens for each light source to cover the light source, thus further improving the illumination effect of the illumination device.

Figure 11:
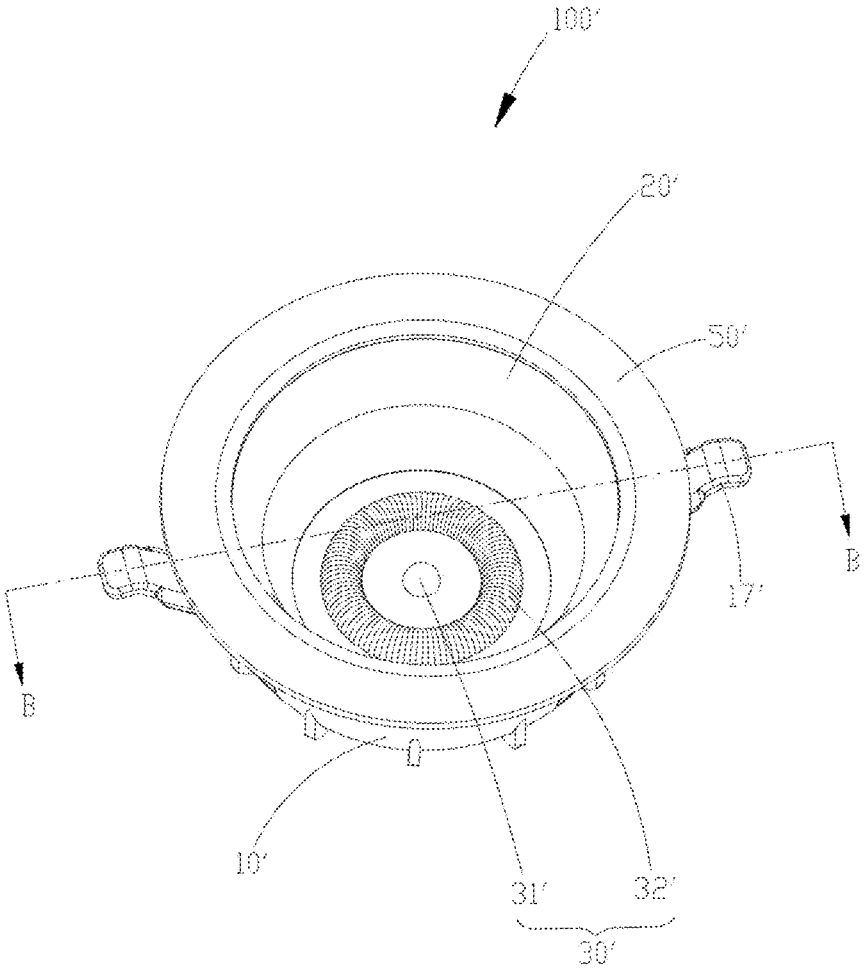
FIG. 11 is a perspective view of an illumination device provided by Example 2 of the present disclosure.
Figure 12:
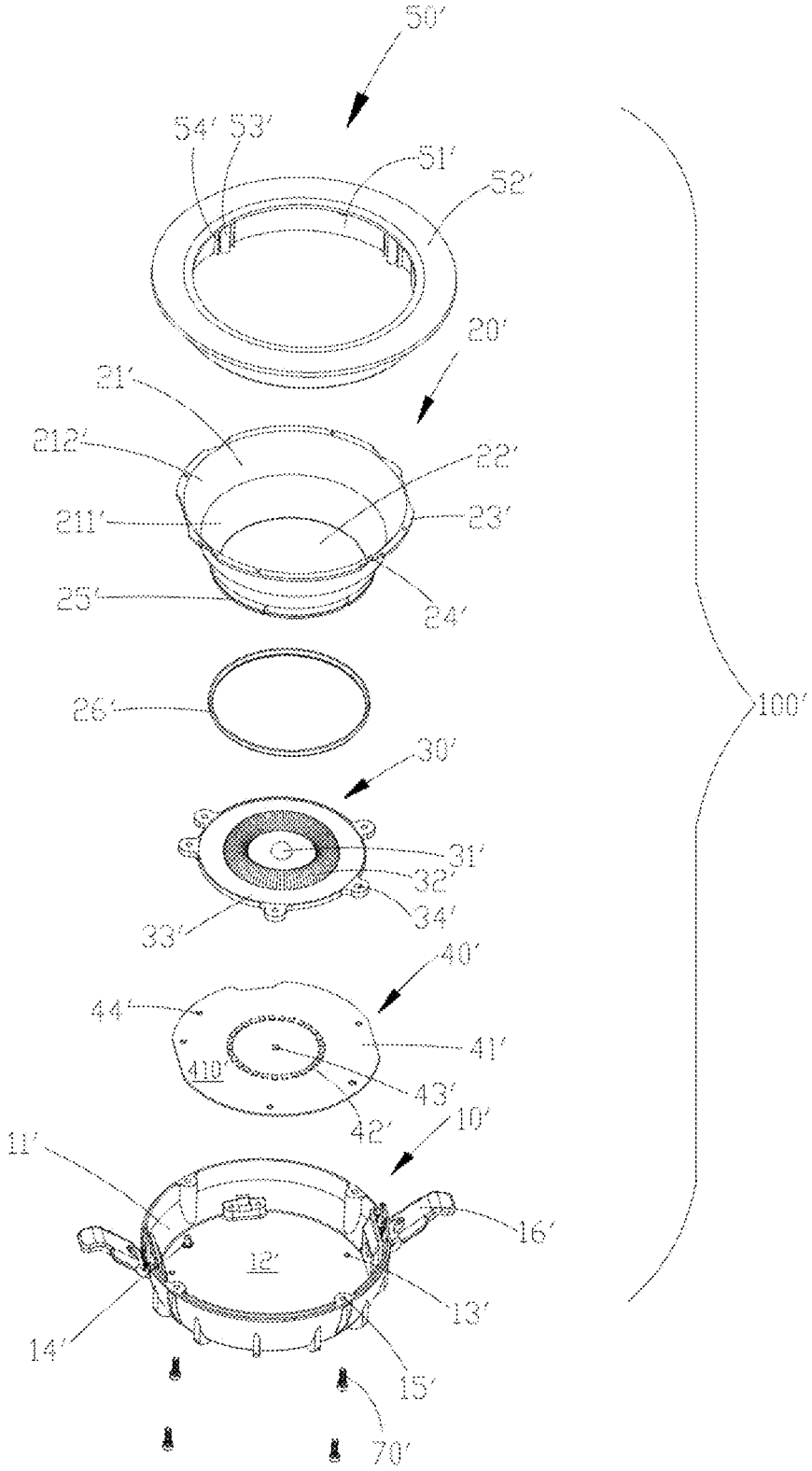
FIG. 12 is an exploded perspective view of the illumination device provided by Example 2 of the present disclosure.
Figure 13:
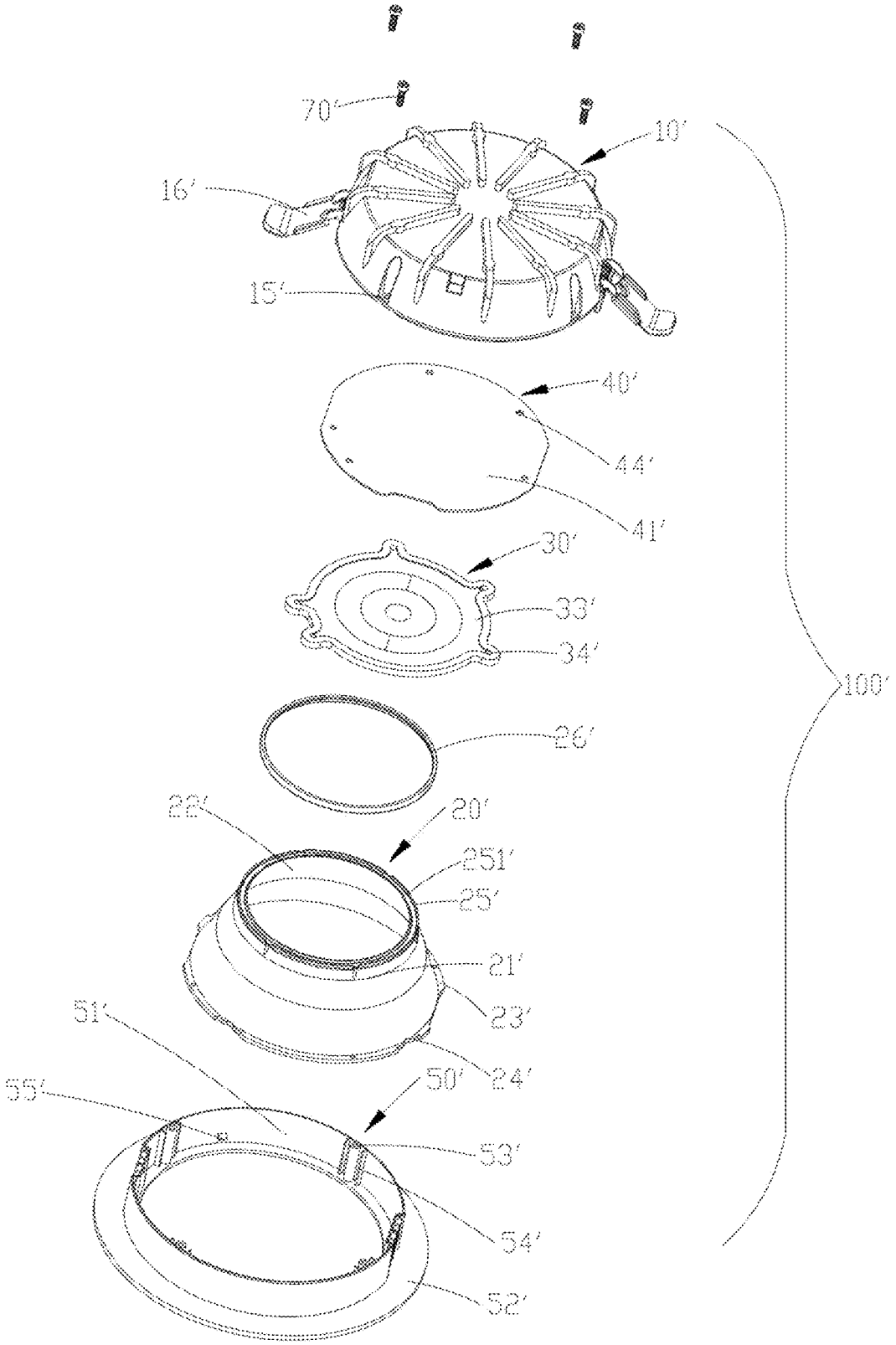
FIG. 13 is an exploded perspective view of the illumination device at another angle provided by Example 2 of the present disclosure.

With combination reference to FIG. 11 to FIG. 13, an illumination device 100' according to this example 2 as illustrated below can include a housing 10', a surface annulus 50' connected with the housing 10', a light source module 40' provided within the housing 10', and a lens combination 30' in cooperation with the light source module 40'.

Figure 14:
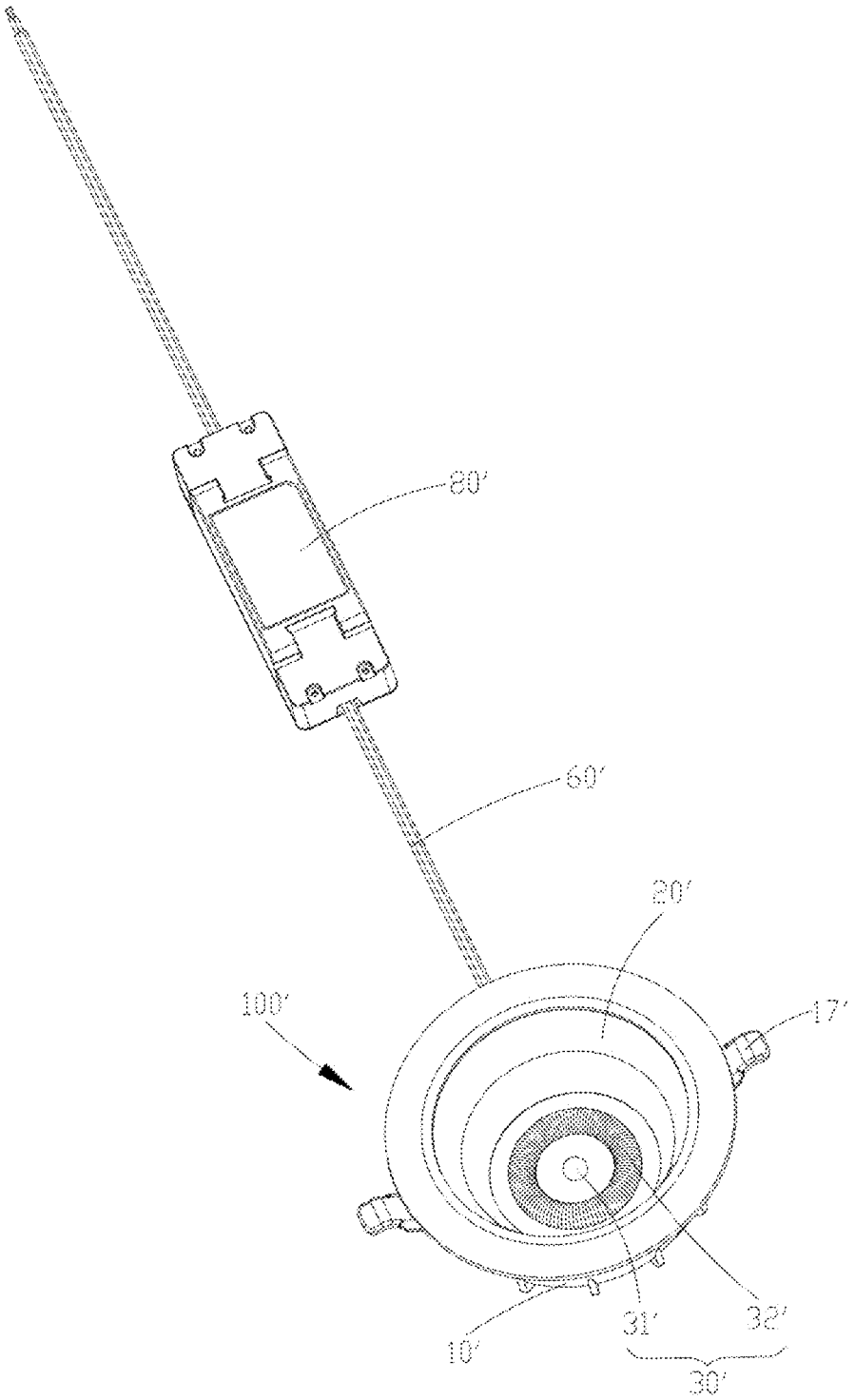
FIG. 14 is a perspective view of the illumination device provided by Example 2 of the present disclosure connected with a drive power supply assembly.

The light source module 40' can include a substrate 41', a plurality of first light source 42' annularly arranged on a first surface 410' (the reference sign is not shown) of the substrate 41', one or more second light sources 43' provided on the first surface 410' of the substrate 41'. Wherein, the second light source 43' is located at the annulus center of the above-described first light sources 42'. The first light sources 42' and the second light source 43' as described above can be light emitting diodes (LEDs), or other types of light emitters. The above-described light source module 40' further includes an electronic device (not shown) provided on the substrate 41'. The light source module 40' can be integrated with a drive power supply assembly (not shown) for driving the light source module 40', the drive power supply assembly can be integrated on the first surface 410' of the substrate 41', or on the second surface provided opposite to the first surface 410'. Of course, the drive power supply assembly can also be provided externally, as shown in FIG. 14, the illumination device 100' further includes a drive power supply assembly 80', and the drive power supply assembly 80' is electrically connected with the light source module 40' within the housing 10' through a lead 60'.

Accordingly, the lens combination 30' can include a base portion 33' for bonding to the substrate 41' of the above-described light source module 40', a first lens 32' connected with the base portion 33' and having an annular shape, and a second lens 31' connected with the base portion 33' and located in an annulus center of the first lens 32'. Wherein, the above-described first lens 32' is provided in cooperation with the above-described first light source 42' of the light source module 40', and the above-described second lens 31' is provided in cooperation with the second light source 43' of the above-described light source module 40'.

It should be noted that, the above-described lens combination 30' is a lens component comprising at least two lenses, the at least two lenses can be provided integrally or non-integrally; the number of lenses comprised in the lens combination 30' is not limited thereto. In the example of the present application, the above-described second lens 31' can be annular or non-annular (e.g., dot-shaped). Preferably, if the first lens 32' and the second lens 31' are both annular, then the annulus center of the first lens 32' (i.e., the annulus center of the annulus presented by the lens) coincides with the annulus center of the second lens 31'; if the first lens 32' is annular and the second lens 31' is dot-shaped, then a position of the second lens 31' can be arranged on the annulus center of the first lens 32', and further, if the second lens 31' is dot-shaped, then a center of the dot of the second lens 31' can be set to coincide with the annulus center of the above-described first lens 32'. Of course, in feasible examples of the present application, mutual positions of the first lens 32' and the second lens 31' as described above are not limited.

Preferably, in order to further enhance a light emitting effect and aesthetics of the illumination device 100', the above-described illumination device 100 can further include an annularly arranged reflective member 20' provided between the housing 10' and the surface annulus 50'. The reflective member 20' is around the outside of the first lens 32. The reflective member 20' includes an inclined reflecting surface 21', an upper end surface 23' and a lower end surface 25' which are horizontally and located at both ends of the reflecting surface 21' respectively, and an opening 22' through which the lens combination 30' passes when mounting. Wherein, the reflecting surface 21' includes a first reflecting surface 211' and a second reflecting surface 212', a surface type of the first reflecting surface 211' is an angular surface, and a surface type of the second reflecting surface 212' is a curved surface. The lower end surface 25', the first reflecting surface 211', the second reflecting surface 212' and the upper end surface 23' are sequentially connected. The upper end surface 23' is provided with a plurality of guide grooves 24', the lower end surface 25' is provided with a circle accommodating groove 251'. A gasket 26' is accommodated in the accommodating groove 251', for improving watertightness of the illumination device 100'. The above-described reflective member 20' can perform electroplated mirror reflection, diffuse reflection, or reflection of an absorptive type, and the like, so as to implement glare control. In addition, the surface type of the reflecting surface 21' is partially curved surface and partially straight surface, so that the light spot is more uniform.

In the example of the present disclosure, the housing 10' can include a bottom wall 12' and a side wall 11' connected with the bottom wall 12'; the bottom wall 12' is provided thereon with a plurality of fixing screw holes 13' and a positioning post 14'; accordingly, the substrate 41' of the light source module 40' is provided thereon with a plurality of via holes (positioning portions 44'). The base portion 33' of the lens combination 30' is provided thereon with a plurality of fixing via holes 34'. The side wall 11' of the housing 10' is also provided thereon with a plurality of fixing screw holes 15' formed by extending from the outer surface toward the end surface, and the side wall 11' is also connected with two circlips 16' thereon.

The surface annulus 50' includes a side wall 51' and an annular surface 52' connected with the side wall 51', the inner surface of the side wall 51' is provided with a plurality of positioning posts 53', both ends of each positioning post 53' are provided with ribs 54', the positioning post 53' is in cooperation with the fixing screw hole 15', and the ribs 54' are in cooperation with two sides of the guide groove 24' so as to play a role of guiding when the reflective member 20' is assembled. A plurality of protrusions 55' are also provided at a position on the inner surface close to the annular surface 52', and the end surface 23' of the reflective member 20' is positioned between the annular surface 52' and the protrusions 55' of the surface annulus 50'.

Figure 15:
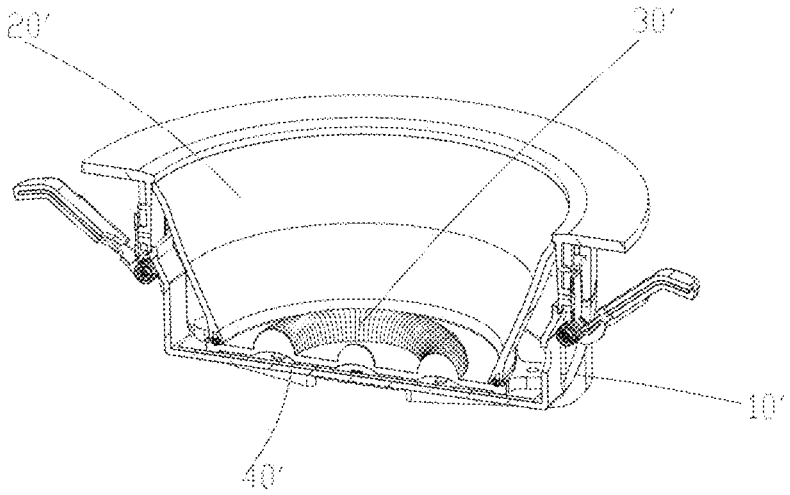
FIG. 15 is a perspective sectional schematic view of the illumination device in a direction of a line B-B of FIG. 11.
Figure 16:
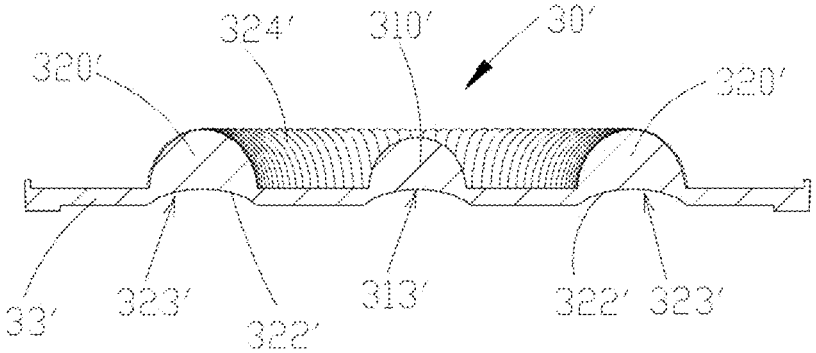
FIG. 16 is a sectional schematic view of a lens combination in the direction of the line B-B of FIG. 11.
Figure 17:
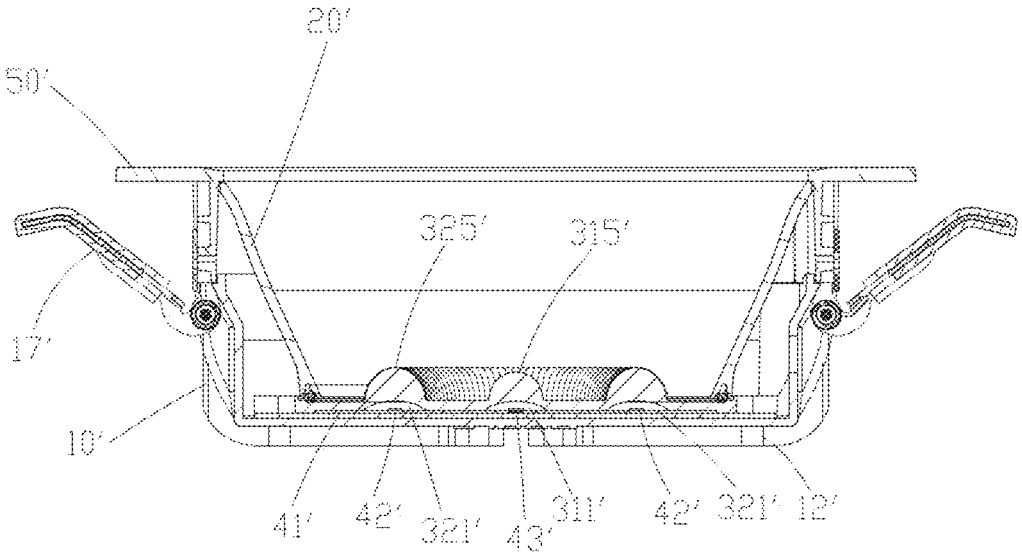
FIG. 17 is a front view of the perspective sectional schematic view shown in FIG. 15.
Figure 18:
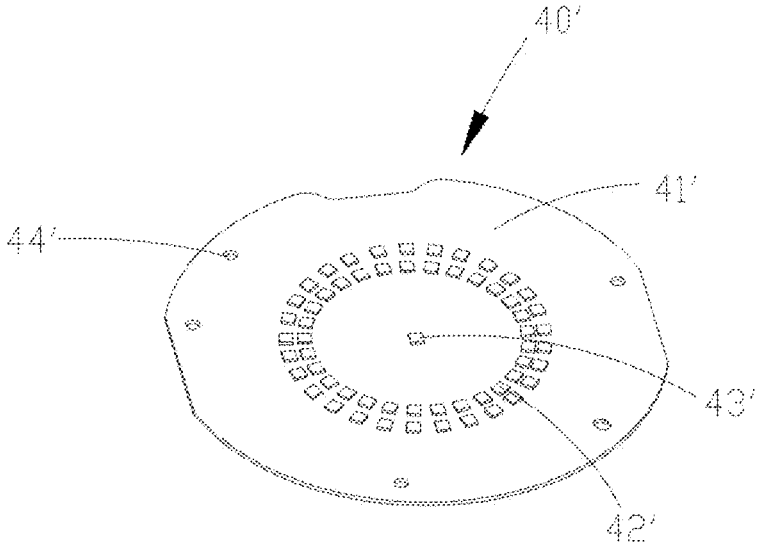
FIG. 18 is another schematic view showing arrangement of a first light source on a light source module in Example 2 of the present disclosure.

During the mounting process, firstly, the light source module 40' is placed on the bottom wall 12' of the housing 10', and during the placing process, the plurality of via holes (positioning portions) 44' of the above-described light source module 40' are respectively fitted over the plurality of fixing screw holes 13' and the positioning posts 14' on the above-described bottom wall 12'; then the lens combination 30' is placed on the first surface 410' of the substrate 41' on which the first light source 42' is provided; during the placing process, positions of the plurality of fixing via holes 34' of the lens combination 30' can be aligned with positions of the plurality of via holes 44' of the light source module 40', then the light source module 40' and the lens combination 30' as described above are fixed within the housing 10', by bolts (not shown) in cooperation with the fixing screw holes 13'. Of course, a mode of combining the light source module 40' and the lens combination 30' as described above is not limited thereto, which may also be adhesive, riveting, and the like. Subsequently, the reflective member 20' is placed on the peripheral of the lens combination 30', by the bolt 70 passing through the fixing screw holes 16' and accommodated within the positioning post 53', connection and fixation between the housing 10', the reflective member 20' and the surface annulus 50' is achieved. Similarly, a mode of combining the reflective member 20' and the housing 10' as described above is not limited thereto, which may also be adhesive, riveting, and the like. With combination reference to FIG. 15 and FIG. 17, wherein, it is defined that a cross section shown in FIG. 15 to FIG. 17 is obtained by cross-sectioning along a second cross-section line (i.e., the B-B direction shown in FIG. 11), and the second cross-section line passes through the annulus center of the first lens 32'. The first lens 32' includes a first lens main body 320' having an annular shape and a first groove 323' formed inwardly recessed from the base portion 33', the second lens 31' includes a second lens main body 310' and a second groove 313' formed inwardly recessed from the base portion 33'. The above-described first lens 32' has a first light incident surface 322' and a first light emergent surface 324' opposite to each other; when the lens combination 30' and the light source module 40' are mounted, due to presence of the above-described first groove 323', a first cavity 321' for accommodating the above-described first light source 42' can be formed between the above-described first light incident surface 322' and the above-described first surface 410' (with reference to FIG. 12). Similarly, the above-described second lens 31' also has a second light incident surface and a second light emergent surface opposite to each other; and due to presence of the above-described second groove 313', when the lens combination 30' and the light source module 40' are mounted, a second cavity 311' for accommodating the above-described second light source 43' is formed between the second light incident surface of the second lens 31' and the above-described first surface 410'. In the example of the present disclosure, the annularly distributed first light sources 42' of the light source module 40' can be accommodated within the first cavity 321' of the above-described first lens 32'; in this example, the first light source 42' is provided in a form of one ring; and in other alternative examples, for example, as shown in FIG. 18, the first light source 42' is provided in a form of two or more rings, so that more light sources can be provided within limited space of the illumination device 100', to further improve luminous efficiency of the illumination device 100'. In addition, the lens combination 30' may accordingly adjust the number of first light sources 42' located within the first lens 32', according to a size of a desired light flux. Moreover, the above-described lens combination 30' may share a variety of packages, with good compatibility, and an arrangement mode of the light source on the substrate 41' is more flexible.

Besides, it should be noted that, in the example of the present disclosure, the first light incident surface 322' and the first light emergent surface 324' of the first lens 32' are provided as curved surfaces, and a curvature radius of the first light incident surface 322' is larger than a curvature radius of the first light emergent surface 324'. In this way, when the light source of the illumination device is mounted within the lens combination 30', incident light emitted by the light source is completely transmitted through the lens combination 30' to be emitted outward, and the first lens 32' of the above-described curved surface shape may render better luminous efficiency and better light distribution effect. In the example of the present disclosure, the substrate 41' of the light source module 40' and the base portion 33' of the lens combination 30' are bonded to each other, to form the first cavity 321' or the second cavity 311' surrounded by the substrate 41' and the base portion 33', the respective first light sources 42' and the respective second light sources 43' are completely accommodated in the first cavity 321' or the second cavity 311' as described above, so that it is possible to ensure that incident light can be completely transmitted from the lens combination 30' and irradiated to the outside of the illumination device, thus resulting in higher luminous efficiency.

With reference to FIG. 15, in order that light distribution effects of the respective light sources on the illumination device after passing through the above-described lens combination 30' coincide with one another, in this example, a surface type of the first sectional surface obtained along the first cross-section line in the first lens 32' and a surface type of the second sectional surface obtained along the first cross-section line in the second lens 31' do not coincide with one another. In this example, a height of the above-described first lens 32' in a thickness direction of the base portion 33' is not equal to a height of the second lens 31' in the thickness direction of the base portion 33'. That is, if the height of the first lens 32' in the thickness direction of the base portion 33' is defined as a first vertical distance from a first top portion 325' of the first lens 32' to the base portion 33'; and the height of the second lens 31' in the thickness direction of the base portion 33' is defined as a second vertical distance from a second top portion 315' of the second lens 31' to the base portion 33'; then the above-described first vertical distance can be larger than or smaller than the second vertical distance. Of course, in a preferred example, the above-described first vertical distance is set to be larger than the above-described second vertical distance.

Figure 19:
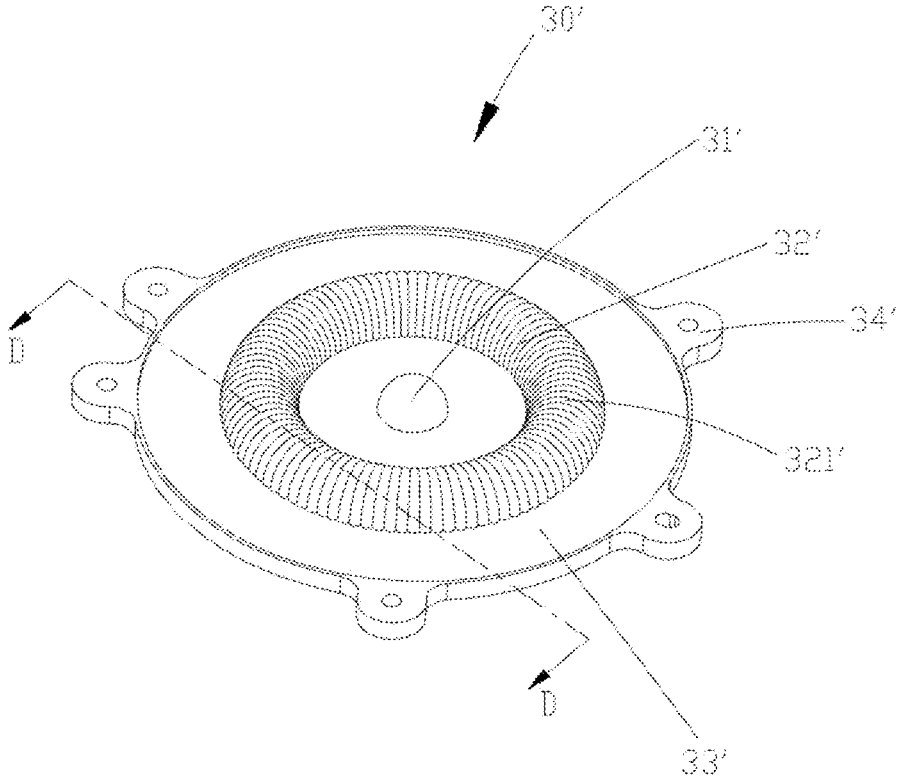
FIG. 19 is a structural schematic view of the lens combination on a side of a light emergent surface in Example 2 of the present disclosure.
Figure 20:
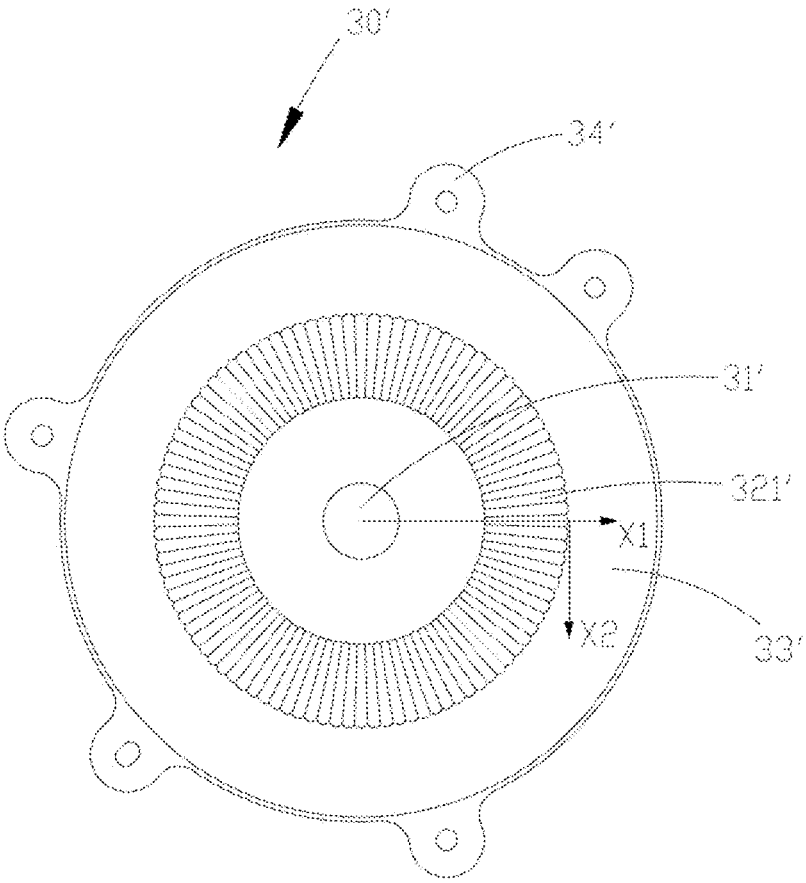
FIG. 20 is a top view of the lens combination in Example 2 of the present disclosure.

If the outer surface of the annular first lens 32' is a smooth wall surface, then, it only has light control in a radial direction X1, but no light control in a tangential direction X2; light reflected by the reflective member 20' is liable to form a bright ring, which affects uniformity of the light spot. Therefore, in this example, with the lens combination 30' as shown in FIG. 19, occurrence of the bright ring can be avoided, to improve a visual effect. In this example, a plurality of flanges 321' parallel to each other can be provided on the outer surface of the first light emergent surface 324' of the first lens 32'; the plurality of flanges 321' are uniformly arranged at intervals in an extending direction of the first lens 32', and each flange 321' protrudes along the outer surface of the first lens 32'. By providing a plurality of equally divided flanges 321' in the extending direction, light in the tangential direction X2 is further dispersed to implement uniformity of the light spot. Of course, the above-described flange 321' may also be provided on the first light incident surface 322' and the first light emergent surface 324' at a same time. In a same principle, a plurality of equally divided flanges 321' may also be provided on the second light incident surface and/or the second light emergent surface of the second lens 31'. In a preferred example of the present disclosure, curvature of the flanges 321' coincides with that of the light incident surface or the light emergent surface provided.

Figure 21:
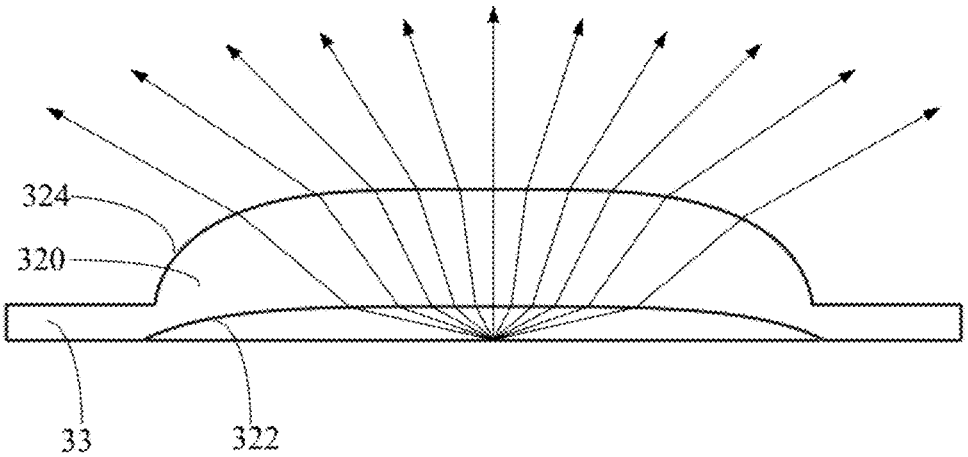
FIG. 21 is an optical path diagram in a cross section of the lens combination of Example 1 in the direction of the line C-C of FIG. 2.
Figure 22:
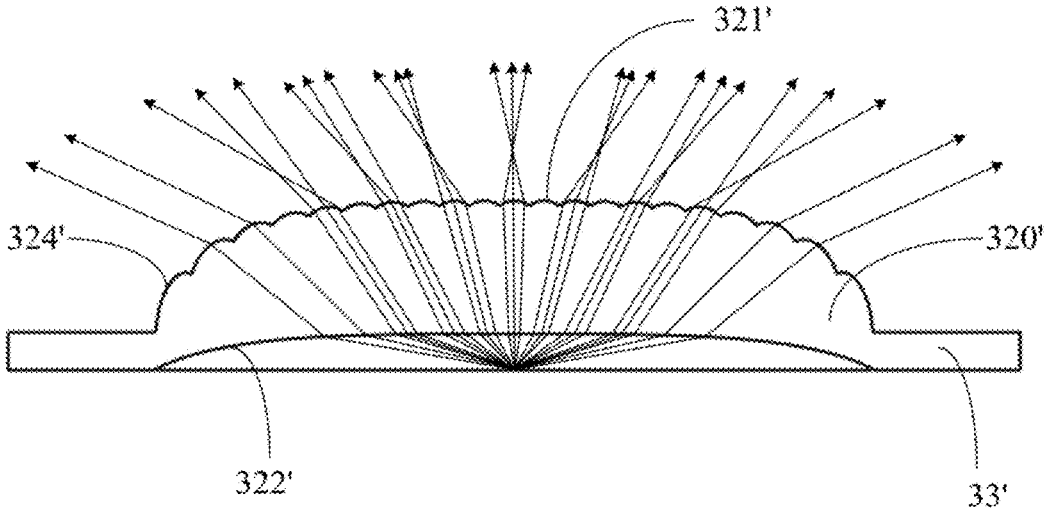
FIG. 22 is an optical path diagram in a cross section of the lens combination of Example 2 in the direction of the line D-D of FIG. 19.

As shown in FIG. 21, the first light emergent surface 324 of the first lens 32 is a smooth wall surface, and light enters from the first light incident surface 322 of the first lens 32 and is emitted from the first light emergent surface 324; as shown in FIG. 22, the first light emergent surface 324' of the first lens 32' is provided with a plurality of flanges 321', light enters from the first light incident surface 322' of the first lens 32' and is emitted from the first light emergent surface 324'; by comparing optical paths shown in FIG. 22 and FIG. 21, with respect to the first lens 32, because the flanges 321' are provided on the first light emergent surface 324' in the first lens 32', light beams irradiated on different flanges 321' at different incident angles and refracted by the flange 321' and emitted out, the light beam is emitted dispersedly; that is, emergent light is further scattered, which eliminates a problem of the bright ring generated due to failing to control light in the tangential direction X2 of the original first lens 32.

An etch structure and a frosted structure may also be used in the first light incident surface 322' and the second light incident surface, so that a light beam angle of emergent light obtained after incident light generated by the above-described first light source 42' passes through the lens combination 30' meets a certain requirement.

In summary, in the lens combination 30' used in the illumination device according to Example 2 of the present disclosure, a plurality of consecutive flanges are provided on the light emergent surface of at least one lens therein, thus avoiding a situation of occurrence of the bright ring formed by light emitted from the light emergent surface, further improves uniformity of the light spot, and improving an illumination effect of the illumination device.

Further, the present disclosure discloses an illumination device adopting lens combination, comprising: a housing; a light source module, located within the housing, the light source module including a substrate and a first light source and a second light source provided on the substrate; and a lens combination, comprising a base portion, and a first lens and a second lens provided on the base portion, the first lens being annular, and the second lens being annularly enclosed within the first lens; wherein, the base portion of the lens combination is integrated with the substrate and the housing of the light source module, the first lens and the second lens distribute light for the first light source and the second light source respectively, the first lens corresponds to at least one group of first lenses annularly arranged on the substrate, and the second lens corresponds to at least one second light source annularly enclosed within the first light source.

The illumination device according to the above example, wherein, the base portion of the lens combination is provided with at least two fixing via holes located on an outer periphery of the first lens, the substrate of the light source module is provided with at least two positioning portions aligned with the fixing via holes, the housing is provided with a bottom wall and an annular side wall formed by extending from the outer periphery of the bottom wall, the base portion of the lens combination, the substrate of the light source module are locked by at least two screws to the bottom wall of the housing.

The illumination device according to the above example, wherein, the illumination device further comprises a reflective member, the reflective member being assembled within the housing and placed at the base portion of the lens combination, and the reflective member possessing a reflective surface annularly provided on the outer periphery of the first lens.

The illumination device according to the above example, wherein, the housing has a bottom wall and an annular side wall formed extending from the outer periphery of the bottom wall, the reflective member has a mounting wall and an arc-shaped reflecting surface, the mounting wall of the reflective member and the bottom wall of the housing are assembled, the arc-shaped reflective surface annularly surrounds the outer periphery of the first lens and receives emergent light emitted from the first light source and the second light source and distributed by the first lens and the second lens.

The illumination device according to the above example, wherein, the mounting wall of the reflective member is fastened to be fitted with the annular side wall of the housing, and the reflective member is flush with an upper surface of the housing.

The illumination device according to the above example, wherein, at least a drive module is integrated on the light source module, and an accommodation space for accommodating the drive module presents between the housing and the reflective member.

The illumination device according to the above example, further comprising a reflective member and a surface annulus, wherein, the surface annulus is assembled to the housing, and the reflective member is sandwiched between the housing and the substrate of the light source module, and the reflective member has a reflective surface annularly provided on the outer periphery of the first lens.

The illumination device according to the above example, wherein, the reflecting surface of the reflective member includes a first reflecting surface and a second reflecting surface, a surface type of the first reflecting surface is an inclination surface, and a surface type of the second reflecting surface is a curved surface.

The illumination device according to the above example, wherein, a first sectional surface of the first lens obtained along a first cross-section line and a second sectional surface of the second lens obtained along a first cross-section line are not consistent in surface type.

The illumination device according to the above example, wherein, the first lens includes a first light incident surface, a first light emergent surface, and a first accommodation space located on a side of the first light incident surface and configured for accommodating the first light source, the first light incident surface and the first light emergent surface are curved surfaces; the second lens includes a second light incident surface, a second light emergent surface, and a second accommodation space located on a side of the second light incident surface and configured for accommodating the second light source, the second light incident surface and the second light emergent surface are curved surfaces; and an emergent light obtained after an incident light emitted by the first light source passes through the first light incident surface and the first light emergent surface and an emergent light obtained after an incident light emitted by the second light source passes through the second light incident surface and the second light emergent surface are consistent in light type.

The illumination device according to the above example, wherein, on the first light emergent surface and/or the first light incident surface of the first lens, a plurality of flanges parallel to each other are provided on an outer surface of the first light emergent surface or an inner surface of the first light incident surface, and are arranged at intervals in an extending direction of the lens.

The illumination device according to the above example, wherein, a curvature radius of the first light incident surface is larger than a curvature radius of the first light emergent surface; and a curvature radius of the second light incident surface is larger than a curvature radius of the second light emergent surface.

The illumination device according to the above example, wherein, the first lens correspondingly accommodates two groups of first light sources arranged in annular shape.

The present disclosure provides a lens combination and an illumination device adopting the lens combination, wherein, the lens combination configured for accommodation at least a first light source and a second light source, includes: a first lens, including a first light incident surface, a first light emergent surface and a first accommodation space located on a side of the first light incident surface and configured for accommodating the first light source; the first light incident surface and the first light emergent surface being of a curved surface shape; and a second lens, including a second light incident surface, a second light emergent surface, and a second accommodation space located on a side of the second light incident surface and configured for accommodating the second light source; the second light incident surface and the second light emergent surface being of a curved surface shape. An emergent light obtained after an incident light emitted by a first light source passes through the first light incident surface and the first light emergent surface and an emergent light obtained after an incident light emitted by the second light source passes through the second light incident surface and the second light emergent surface are consistent in light type The present disclosure solves a problem that it is difficult to ensure obtaining a same light distribution effect, after light emitted by different light sources is transmitted through the lenses covering the light sources.

An object of examples of the present disclosure is to provide a lens combination and an illumination device adopting the same, to solve a problem that it is difficult to ensure obtaining a same light distribution effect, after light emitted by different light sources is transmitted through the lenses covering the light sources.

In order to implement the above-described object, the lens combination and the illumination device adopting the lens combination provided by the examples of the present disclosure are implemented as follows:

A lens combination, configured for accommodation at least a first light source and a second light source, wherein, the lens combination comprises:

a first lens, including a first light incident surface, a first light emergent surface and a first accommodation space located on a side of the first light incident surface and configured for accommodating the first light source; the first light incident surface and the first light emergent surface being of a curved surface shape; and a second lens, including a second light incident surface, a second light emergent surface, and a second accommodation space located on a side of the second light incident surface and configured for accommodating the second light source; the second light incident surface and the second light emergent surface being of a curved surface shape;

wherein, an emergent light obtained after an incident light emitted by a first light source passes through the first light incident surface and the first light emergent surface and an emergent light obtained after an incident light emitted by the second light source passes through the second light incident surface and the second light emergent surface are consistent in light type.

Furthermore, the first lens and the second lens are provided integrally or separately.

Furthermore, the first lens is ring-shaped.

Furthermore, the first lens is configured such that an included angle between a normal line and the incident light emitted by the first light source is larger than an included angle between the normal line and the emergent light obtained after the incident light passing through the light incident surface and the light emergent surface; the second lens is configured such that an included angle between the incident light emitted by the second light source and the normal line is larger than an included angle between the normal line and the emergent light obtained after the incident light passing through the light incident surface and the light emergent surface.

Furthermore, the second lens is ring-shaped or dot-shaped; if the second lens is ring-shaped, then an annulus center of the first lens coincides with an annulus center of the second lens; if the second lens is dot-shaped, then the second lens is located at the annulus center of the first lens.

Furthermore, a first sectional surface of the first lens obtained along the first cross-section line and a second sectional surface of the second lens obtained along the first cross-section line are not consistent in surface type, and the first cross-section line passes through the annulus center of the first lens.

Furthermore, a concavo-convex structure is located on the first light incident surface and/or the first light emergent surface, a concavo-convex structure is located on the second light incident surface and/or the second light emergent surface, and the concavo-convex structures includes one or more of an etch structure and a frosted structure.

Furthermore, a dispersion angle corresponding to the etch structure or the frosted structure is positively correlated with a distribution angle of the first light source within the first accommodation space or a distribution angle of the second light source within the second accommodation space.

Furthermore, a granular-sensation eliminating layer with a concavo-convex shape is formed on the first light incident surface and/or the first light emergent surface, and a granular-sensation eliminating layer with a concavo-convex shape is formed on the second light incident surface and/or the second light emergent surface.

Furthermore, on the first light emergent surface and/or the first light incident surface of the first lens, a plurality of flanges parallel to each other are provided on an outer surface of the first light emergent surface or an inner surface of the first light incident surface, and are arranged at intervals in an extending direction of the lens.

Furthermore, a curvature radius of the first light incident surface is larger than a curvature radius of the first light emergent surface; and a curvature radius of the second light incident surface is larger than a curvature radius of the second light emergent surface.

Furthermore, the second lens is dot-shaped or annular, the first lens is annular and annularly arranged on an outer periphery of the second lens, and a height of the first lens and a height of the second lens are not in consistent.

Furthermore, a top portion of the first lens is higher than a top portion of the second lens.

Furthermore, the lens combination has a plate base portion, both the first lens and the second lens are provided on the base portion, and the base portion is provided with at least two fixing via holes for assembling screws.

To achieve the above object, the present disclosure provides a lens combination comprising: a second lens and a first lens provided on an outer periphery of the second lens, the first lens having a first light incident surface and a first light emergent surface, the second lens having a second light incident surface and a second light emergent surface, the first light incident surface and the second light incident surface, and the first light emergent surface and the second light emergent surface are all curved surfaces, and a first sectional surface of the first lens obtained along a first cross-section line and a surface type of a second sectional surface of the second lens obtained along the first cross-section line are not consistent in surface type.

Furthermore, the first lens and the second lens are not consistent in height, and the first lens is higher than the second lens.

Furthermore, the second lens is ring-shaped or dot-shaped, and the first lens is ring-shaped.

Furthermore, the lens combination has a plate base portion, both the first lens and the second lens are provided on the base portion, and the base portion is provided with at least two fixing via holes for assembling screws.

Furthermore, on the first light emergent surface and/or the first light incident surface of the first lens, a plurality of flanges parallel to each other are provided on an outer surface of the first light emergent surface or an inner surface of the first light incident surface, and are arranged at intervals in an extending direction of the lens.

Furthermore, a curvature radius of the first light incident surface is larger than a curvature radius of the first light emergent surface; and a curvature radius of the second light incident surface is larger than a curvature radius of the second light emergent surface.

To achieve the above object, the present disclosure provides an illumination device adopting lens combination, comprising:

a housing;

a light source module, located within the housing, the light source module including a substrate and a first light source and a second light source provided on the substrate; and a lens combination, comprising a base portion, and a first lens and a second lens provided on the base portion, the first lens being annular, and the second lens being annularly enclosed within the first lens;

wherein, the base portion of the lens combination is integrated with the substrate and the housing of the light source module, the first lens and the second lens distribute light for the first light source and the second light source respectively, the first lens corresponds to at least one group of first lenses annularly arranged on the substrate, and the second lens corresponds to at least one second light source annularly enclosed within the first light source.

Furthermore, the base portion of the lens combination is provided with at least two fixing via holes located on an outer periphery of the first lens, the substrate of the light source module is provided with at least two positioning portions aligned with the fixing via holes, the housing is provided with a bottom wall and an annular side wall formed by extending from the outer periphery of the bottom wall, the base portion of the lens combination, the substrate of the light source module are locked by at least two screws to the bottom wall of the housing.

Furthermore, the illumination device further comprises a reflective member, the reflective member being assembled within the housing and placed at the base portion of the lens combination, and the reflective member possessing a reflective surface annularly provided on the outer periphery of the first lens.

Furthermore, the housing has a bottom wall and an annular side wall formed extending from the outer periphery of the bottom wall, the reflective member has a mounting wall and an arc-shaped reflecting surface, the mounting wall of the reflective member and the bottom wall of the housing are assembled, the arc-shaped reflective surface annularly surrounds the outer periphery of the first lens and receives emergent light emitted from the first light source and the second light source and distributed by the first lens and the second lens.

Furthermore, the mounting wall of the reflective member is fastened to be fitted with the annular side wall of the housing, and the reflective member is flush with an upper surface of the housing.

Furthermore, at least a drive module is integrated on the light source module, and an accommodation space for accommodating the drive module presents between the housing and the reflective member.

Furthermore, the illumination device further comprises a reflective member and a surface annulus, wherein, the surface annulus is assembled to the housing, and the reflective member is sandwiched between the housing and the substrate of the light source module, and the reflective member has a reflective surface annularly provided on the outer periphery of the first lens.

Furthermore, the reflecting surface of the reflective member includes a first reflecting surface and a second reflecting surface, a surface type of the first reflecting surface is an inclination surface, and a surface type of the second reflecting surface is a curved surface.

Furthermore, a first sectional surface of the first lens obtained along a first cross-section line and a second sectional surface of the second lens obtained along a first cross-section line are not consistent in surface type.

Furthermore, the first lens includes a first light incident surface, a first light emergent surface, and a first accommodation space located on a side of the first light incident surface and configured for accommodating the first light source, the first light incident surface and the first light emergent surface are curved surfaces; the second lens includes a second light incident surface, a second light emergent surface, and a second accommodation space located on a side of the second light incident surface and configured for accommodating the second light source, the second light incident surface and the second light emergent surface are curved surfaces; and an emergent light obtained after an incident light emitted by the first light source passes through the first light incident surface and the first light emergent surface and an emergent light obtained after an incident light emitted by the second light source passes through the second light incident surface and the second light emergent surface are consistent in light type.

Furthermore, on the first light emergent surface and/or the first light incident surface of the first lens, a plurality of flanges parallel to each other are provided on an outer surface of the first light emergent surface or an inner surface of the first light incident surface, and are arranged at intervals in an extending direction of the lens.

Furthermore, a curvature radius of the first light incident surface is larger than a curvature radius of the first light emergent surface; and a curvature radius of the second light incident surface is larger than a curvature radius of the second light emergent surface.

Furthermore, the first lens correspondingly accommodates two groups of first light sources arranged in annular shape.

According to the above technical solution provided by the present disclosure, it can be seen that the lens combination used in the illumination device according to the present disclosure allows an emergent light type obtained after incident light emitted by a first light source accommodated in a first accommodation space passes through a first light incident surface and a first light emergent surface, coincides with an emergent light type obtained after incident light emitted by a second light source accommodated in a second accommodation space passes through a second light incident surface and a second light emergent surface, so it is possible to ensure that a first lens and a second lens in the lens combination may have a same light distribution effect, to avoid providing one lens covering the light source respectively for each light source, and to further improve an illumination effect of the illumination device.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the computing system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors.

The above is only examples of the present disclosure, and not intended to limit the present disclosure. For those skilled in the art, various changes and modifications can be made to the present disclosure. Any modifications, equivalent alternations and improvements without departing from the spirit and principle of the present disclosure shall be included within the protection scope thereof.

The invention claimed is:

1. A lens combination for accommodating at least a first light source and a second light source, comprising:

a first lens, comprising a first light incident surface, a first light emergent surface and a first accommodation space located on a side of the first light incident surface and configured for accommodating the first light source, wherein a curvature radius of the first light incident surface is larger than a curvature radius of the first light emergent surface; and a second lens, comprising a second light incident surface, a second light emergent surface, and a second accommodation space located on a side of the second light incident surface and configured for accommodating the second light source;

wherein an emergent light is obtained after an incident light emitted by a first light source passes through the first light incident surface and the first light emergent surface, and an incident light emitted by the second light source passes through the second light incident surface and the second light emergent surface;

wherein the first lens is a ring-shaped lens with a constant height and the second lens is located at a center of the first lens; and wherein the emergent light obtained after the incident light emitted by the first light source passes through the first light incident surface and all of the emergent light moves toward a center axis of the first light source.

2. The lens combination according to claim 1, wherein the first light incident surface and the first light emergent surface comprise a first curved surface shape and the second light incident surface and the second light emergent surface comprise a second curved surface shape.

3. The lens combination according to claim 1, wherein:

the first lens is configured such that an included angle between a normal line and the incident light emitted by the first light source is larger than an included angle between the normal line and the emergent light obtained after the incident light passing through the light incident surface and the light emergent surface; and the second lens is configured such that an included angle between the incident light emitted by the second light source and the normal line is larger than an included angle between the normal line and the emergent light obtained after the incident light passing through the light incident surface and the light emergent surface.

4. The lens combination according to claim 1, wherein:

the second lens is ring-shaped or dot-shaped; if the second lens is ring-shaped, then an annulus center of the first lens coincides with an annulus center of the second lens; and when the second lens is dot-shaped, the second lens is located at the annulus center of the first lens.

5. The lens combination according to claim 4, wherein a first sectional surface of the first lens obtained along a first cross-section line and a second sectional surface of the second lens obtained along the first cross-section line are not consistent in surface type, and the first cross-section line passes through the annulus center of the first lens.

6. The lens combination according to claim 1, wherein a first concavo-convex structure is located on the first light incident surface and/or the first light emergent surface, a second concavo-convex structure is located on the second light incident surface and/or the second light emergent surface, and each of the first concavo-convex structure and the first concavo-convex structure comprises one or more of an etch structure and a frosted structure.

7. The lens combination according to claim 6, wherein the dispersion angle corresponding to the etch structure or the frosted structure is positively correlated with the distribution angle of the first light source within the first accommodation space or a distribution angle of the second light source within the second accommodation space.

8. The lens combination according to claim 1, wherein on the first light emergent surface and/or the first light incident surface of the first lens, a plurality of flanges parallel to each other are provided on an outer surface of the first light emergent surface or an inner surface of the first light incident surface, and are arranged at intervals in an extending direction of the lens.

9. The lens combination according to claim 1, wherein:

a curvature radius of the first light incident surface is larger than a curvature radius of the first light emergent surface; and a curvature radius of the second light incident surface is larger than a curvature radius of the second light emergent surface.

10. The lens combination according to claim 1, wherein the second lens is dot-shaped or annular, the first lens is annular and annularly arranged on an outer periphery of the second lens, and a first height of the first lens and a second height of the second lens are not in consistent.

11. The lens combination according to claim 1, wherein the lens combination has a plate base portion, both the first lens and the second lens are provided on the base portion, and the base portion is provided with at least two fixing via holes for assembling screws.

12. A lens combination comprising:

a first lens and a second lens, wherein the first lens is provided on an outer periphery of the second lens, the first lens comprising a first light incident surface and a first light emergent surface, the second lens comprising a second light incident surface and a second light emergent surface, wherein a first sectional surface of the first lens is obtained along a first cross-section line and a surface type of a second sectional surface of the second lens is obtained along the first cross-section line, a curvature radius of the first light incident surface is larger than a curvature radius of the first light emergent surface, the first lens is a ring-shaped lens with a constant height and the second lens is located at a center of the first lens, and wherein light emitted from the first light source passes through the first lens so that all of the light moves toward a center axis of the first light source.

13. The lens combination according to claim 12, wherein the first lens and the second lens are not consistent in height, and the first lens is higher than the second lens.

14. The lens combination according to claim 12, wherein the second lens is ring-shaped or dot-shaped.

15. The lens combination according to claim 12, wherein the lens combination has a plate base portion, both the first lens and the second lens are provided on the base portion, and the base portion is provided with at least two fixing via holes for assembling screws.

16. The lens combination according to claim 12, wherein, on the first light emergent surface and/or the first light incident surface of the first lens, a plurality of flanges parallel to each other are provided on an outer surface of the first light emergent surface or an inner surface of the first light incident surface, and are arranged at intervals in an extending direction of the lens.

17. An illumination device adopting lens combination, comprising:

a housing;

a light source module, located within the housing, the light source module comprising a substrate and a first light source and a second light source provided on the substrate; and a lens combination, comprising a base portion, and a first lens and a second lens provided on the base portion, the first lens being annular, and the second lens being annularly enclosed within the first lens;

wherein the base portion of the lens combination is integrated with the substrate and the housing of the light source module, the first lens and the second lens distribute light for the first light source and the second light source respectively, the first lens corresponds to at least one group of first lenses annularly arranged on the substrate, and the second lens corresponds to at least one second light source annularly enclosed within the first light source;

wherein the first lens comprises a first light incident surface and a first light emergent surface, and a curvature radius of the first light incident surface is larger than a curvature radius of the first light emergent surface;

wherein the first lens is a ring-shaped lens with a constant height and the second lens is located at a center of the first lens; and wherein light emitted from the first light source passes through the first lens so that all of the light moves toward a center axis of the first light source.

18. The illumination device according to claim 17, wherein the base portion of the lens combination is provided with at least two fixing via holes located on an outer periphery of the first lens, the substrate of the light source module is provided with at least two positioning portions aligned with the fixing via holes, the housing is provided with a bottom wall and an annular side wall formed by extending from the outer periphery of the bottom wall, the base portion of the lens combination, the substrate of the light source module are locked by at least two screws to the bottom wall of the housing.

19. The illumination device according to claim 18, wherein the illumination device further comprises a reflective member, the reflective member being assembled within the housing and placed at the base portion of the lens combination, and the reflective member possessing a reflective surface annularly provided on the outer periphery of the first lens.

20. The illumination device according to claim 19, wherein the housing has a bottom wall and an annular side wall formed extending from the outer periphery of the bottom wall, the reflective member has a mounting wall and an arc-shaped reflecting surface, the mounting wall of the reflective member and the bottom wall of the housing are assembled, the arc-shaped reflective surface annularly surrounds the outer periphery of the first lens and receives emergent light emitted from the first light source and the second light source and distributed by the first lens and the second lens.

21. The illumination device according to claim 20, wherein the mounting wall of the reflective member is fastened to be fitted with the annular side wall of the housing, and the reflective member is flush with an upper surface of the housing.

22. The illumination device according to claim 20, wherein at least a drive module is integrated on the light source module, and an accommodation space for accommodating the drive module presents between the housing and the reflective member.

23. The illumination device according to claim 18, further comprising a reflective member and a surface annulus, wherein, the surface annulus is assembled to the housing, and the reflective member is sandwiched between the housing and the substrate of the light source module, and the reflective member has a reflective surface annularly provided on the outer periphery of the first lens.

24. The illumination device according to claim 23, wherein the reflecting surface of the reflective member includes a first reflecting surface and a second reflecting surface, a surface type of the first reflecting surface is an inclination surface, and a surface type of the second reflecting surface is a curved surface.

25. The illumination device according to claim 17, wherein a first sectional surface of the first lens obtained along a first cross-section line and a second sectional surface of the second lens obtained along a first cross-section line are not consistent in surface type.

26. The illumination device according to claim 17, wherein, the first lens correspondingly accommodates two groups of first light sources arranged in annular shape.

* * * * *